US009982576B2

(12) United States Patent
Haltiner, Jr.

(10) Patent No.: US 9,982,576 B2
(45) Date of Patent: May 29, 2018

(54) HYDRAULIC CAMSHAFT PHASER AND VALVE FOR OPERATION THEREOF

(71) Applicant: DELPHI TECHNOLOGIES IP LIMITED, St. Michael (BB)

(72) Inventor: Karl J. Haltiner, Jr., Fairport, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 76 days.

(21) Appl. No.: 15/210,117

(22) Filed: Jul. 14, 2016

(65) Prior Publication Data

US 2018/0016950 A1 Jan. 18, 2018

(51) Int. Cl.

| | |
|---|---|
| ***F01L 1/34*** | (2006.01) |
| ***F01L 1/344*** | (2006.01) |
| ***F01L 1/02*** | (2006.01) |

(52) U.S. Cl.

CPC ..... *F01L 1/3442* (2013.01); *F01L 1/024* (2013.01)

(58) Field of Classification Search

CPC ..... F01L 1/3442; F01L 1/024

See application file for complete search history.

(56) References Cited

U.S. PATENT DOCUMENTS

| | | | | |
|---|---|---|---|---|
| 9,631,525 | B2 | 4/2017 | Oppel et al. | |
| 2012/0152195 | A1 | 6/2012 | Schulze et al. | |
| 2012/0255509 | A1* | 10/2012 | Lichti | F01L 1/3442 123/90.15 |
| 2016/0024978 | A1 | 1/2016 | Lichti | |
| 2017/0183984 | A1 | 6/2017 | Asahi et al. | |

FOREIGN PATENT DOCUMENTS

DE 102012208808 A1 11/2013

* cited by examiner

*Primary Examiner* — Zelalem Eshete
(74) *Attorney, Agent, or Firm* — Joshua M. Haines

(57) ABSTRACT

A camshaft phaser includes an input member and an output member defining an advance chamber and a retard chamber; a valve body having a valve bore which extends along an axis, an annular groove extending radially outward from the valve bore and having a first width in the direction of the axis, and a passage which opens into the annular groove and which extends from the valve bore through the valve body radially outward from the valve bore such that the passage has a second width in the direction of the axis that is greater than the first width of the annular groove. The camshaft phaser also includes a valve spool which moves along the axis within said valve bore, the valve spool having a land which varies a flow area between the valve bore and the annular groove and between the valve bore and the passage.

13 Claims, 18 Drawing Sheets

HYDRAULIC CAMSHAFT PHASER AND VALVE FOR OPERATION THEREOF

TECHNICAL FIELD OF INVENTION

The present invention relates to a camshaft phaser for varying the phase relationship between a crankshaft and a camshaft in an internal combustion engine; more particularly to such a camshaft phaser which is hydraulically actuated; even more particularly to a valve which controls oil flow in the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. One such camshaft phaser is described in United States Patent Application Publication No. US 2016/0024978 to Lichti, hereinafter referred to as Lichti.

Lichti teaches a camshaft phaser attachment bolt which serves to attach the camshaft phaser to the camshaft and which also serves as a valve body having a valve bore within which a valve spool is axially displaced in order to open and close passages in the camshaft phaser attachment bolt. Consequently, axial movement of the valve spool directs oil to fill or vacate the advance and retard chambers in the proper combination to advance and retard the timing. Lichti teaches that advance and retard passages, which are circular in cross-section, extend radially outward from the valve bore to grooves on the outer circumference of the camshaft phaser attachment bolt. Consequently, when corresponding lands of the valve spool begin to open the advance and retard passages, flow increases gradually due to the geometry of the advance and retard passages being circular and cross-section interacting with an annular edge of the valve spool. While this gradual increase in flow may be desirable for providing greater control stability of the camshaft phaser, the maximum flow rate is limited to the flow area of the advance and retard passages that is uncovered by the valve spool, thereby limiting the phasing rate of the camshaft phaser.

Another such camshaft phaser is described in United States Patent Application Publication No. US 2012/0152195 to Schulze et al., hereinafter referred to as Schulze et al. In contrast to Lichti, Schulze et al. teaches a camshaft phaser attachment bolt in which advance and return passages extend radially outward from respective circumferential grooves that extend radially outward from the valve bore. As a result, a rapid increase in flow occurs when the valve spool begins to open the circumferential grooves. The circumferential grooves provide increased flow by providing a greater flow area, thereby resulting increased phasing rates. However, the increased flow comes at the cost of decreased control stability of the camshaft phaser due to the rapid increase in flow which results from the valve lands of the valve spool opening an annular groove rather than individual passages as taught by Lichti.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft and an output member connectable to the camshaft of the internal combustion engine and defining an advance chamber and a retard chamber with the input member. The camshaft phaser also includes a valve body having a valve bore which extends along an axis, an annular groove which extends radially outward from the valve bore and surrounds the axis such that the annular groove has a first width in the direction of the axis, and a passage which opens into the annular groove and which extends from the valve bore through the valve body in a direction that is radially outward from the valve bore such that the passage is in fluid communication with one of the advance chamber and the retard chamber and such that the passage has a second width in the direction of the axis that is greater than the first width of the annular groove. The camshaft phaser also includes a valve spool which moves along the axis within said valve bore between an advance position and a retard position, the valve spool having a land which varies a flow area between the valve bore and the annular groove and between the valve bore and the passage, thereby controlling flow of oil into and out of the one of the advance chamber and the retard chamber which causes the input member to move relative to the output member.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
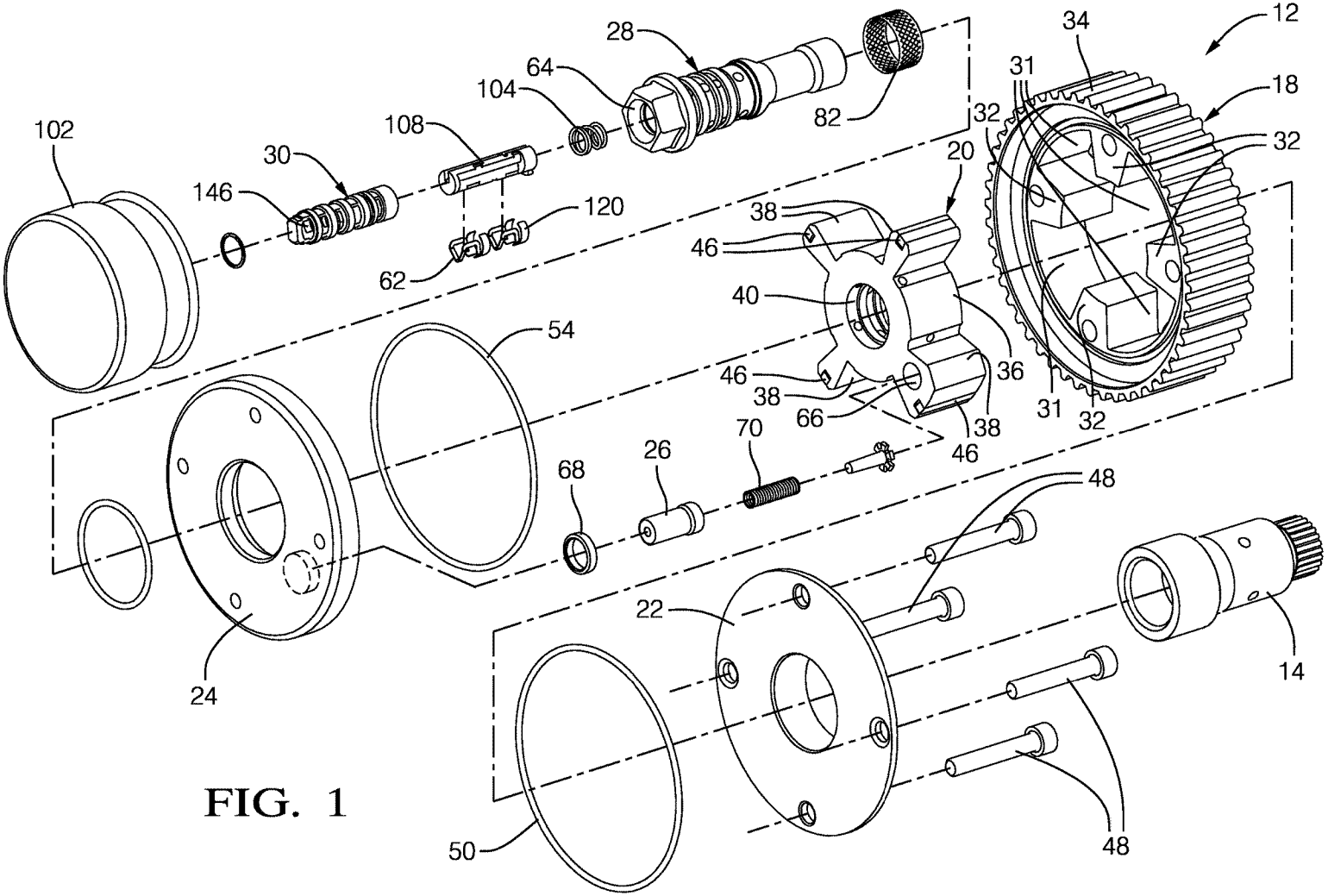
FIG. 1 is an exploded isometric view of a camshaft phaser in accordance with the present invention.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and belt (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14 and to act as a valve body, and a valve spool 30. The various elements of camshaft phaser 12 will be described in greater detail in the paragraphs that follow.

Stator 18 is generally cylindrical and includes a plurality of radial chambers 31 defined by a plurality of lobes 32 extending radially inward. In the embodiment shown, there are four lobes 32 defining four radial chambers 31, however, it is to be understood that a different number of lobes 32 may be provided to define radial chambers 31 equal in quantity to the number of lobes 32. Stator 18 may also include a toothed pulley 34 formed integrally therewith or otherwise fixed thereto. Pulley 34 is configured to be driven by a belt that is driven by the crankshaft of internal combustion engine 10. Alternatively, pulley 34 may be a sprocket driven by a chain or other any other known drive member known for driving camshaft phaser 12 by the crankshaft.

Rotor 20 includes a central hub 36 with a plurality of vanes 38 extending radially outward therefrom and a rotor central through bore 40 extending axially therethrough. The number of vanes 38 is equal to the number of radial chambers 31 provided in stator 18. Rotor 20 is coaxially disposed within stator 18 such that each vane 38 divides each radial chamber 31 into advance chambers 42 and retard chambers 44. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. A back cover seal 50, for example only, an O-ring, may be provided between back cover 22 and stator 18 in order to provide an oil-tight seal between the interface of back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. In an alternative arrangement, pulley 34 may be integrally formed or otherwise attached to back cover 22 rather than stator 18.

Similarly, front cover 24 is sealingly secured, using cover bolts 48, to the axial end of stator 18 that is opposite back cover 22. A front cover seal 54, for example only, an O-ring, may be provided between front cover 24 and stator 18 in order to provide an oil-tight seal between the interface of front cover 24 and stator 18. Cover bolts 48 pass through back cover 22 and stator 18 and threadably engage front cover 24, thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14.

Oil is selectively transferred to advance chambers 42 from retard chambers 44, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44 from advance chambers 42, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 56 may be provided in rotor 20 for supplying and venting oil to and from advance chambers 42 while rotor retard passages 58 may be provided in rotor 20 for supplying and venting oil to and from retard chambers 44. Transferring oil to advance chambers 42 from retard chambers 44 and transferring oil to retard chambers 44 from advance chambers 42 is controlled by valve spool 30 and a phasing check valve 62, as will be described in detail later, such that valve spool 30 is coaxially disposed slidably within a valve bore 64 of camshaft phaser attachment bolt 28 where valve bore 64 is centered about camshaft axis 16. It should now be appreciated that camshaft phaser attachment bolt 28 also acts as a valve body within which valve spool 30 selectively positioned in addition to camshaft phaser attachment bolt 28 functioning to secure camshaft phaser 12 to camshaft 14. In this way, camshaft phaser attachment bolt 28 and valve spool 30 work together as a valve assembly.

Lock pin 26 selectively prevents relative rotation between stator 18 and rotor 20 at a predetermined aligned position of rotor 20 within stator 18, which as shown, may be a full advance position, i.e. rotor 20 as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 72 formed in rotor 20, thereby urging lock pin 26 out of lock pin seat 68 and compressing a lock pin spring 70. Conversely, when lock pin 26 is desired to be seated within lock pin seat 68, the pressurized oil is vented from lock pin bore 66 through rotor lock pin passage 72, thereby allowing lock pin spring 70 to urge lock pin 26 toward front cover 24. In this way, lock pin 26 is seated within lock pin seat 68 by lock pin spring 70 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-14. Camshaft phaser attachment bolt 28 includes bolt supply passages 74 which extend radially outward from valve bore 64 to the outside surface of camshaft phaser attachment bolt 28. Bolt supply passages 74 receive pressurized oil from an oil source 76, for example, an oil pump of internal combustion engine 10, via an annular oil supply passage 78 formed radially between camshaft phaser attachment bolt 28 and a counter bore of camshaft 14 and also via radial camshaft oil passages 80 of camshaft 14. The pressurized oil from oil source 76 is used to 1) replenish oil that may leak from advance chambers 42 and retard chambers 44 in use, 2) to disengage lock pin 26 from lock pin seat 68, and 3) to replenish oil that is vented from lock pin 26. A filter 82 may circumferentially surround camshaft phaser attachment bolt 28 at bolt supply passages 74 in order to prevent foreign matter that may be present in the oil from reaching valve spool 30.

Camshaft phaser attachment bolt 28 also includes a bolt annular lock pin groove 84 on the outer periphery of camshaft phaser attachment bolt 28 and bolt lock pin passages 86 extend radially outward from valve bore 64 to bolt annular lock pin groove 84. Bolt annular lock pin groove 84 is spaced axially apart from bolt supply passages 74 in a direction away from camshaft 14 and is aligned with a rotor annular lock pin groove 88 which extends radially outward from rotor central through bore 40 such that rotor lock pin passage 72 extends from rotor annular lock pin groove 88 to lock pin bore 66. In this way, fluid communication is provided between valve bore 64 and lock pin bore 66.

Camshaft phaser attachment bolt 28 also includes a bolt outer annular advance groove 90 on the outer periphery of camshaft phaser attachment bolt 28, a bolt inner annular advance groove 91 which extends radially outward from valve bore 64 and surrounds camshaft axis 16 coaxial with valve bore 64, and bolt advance passages 92 which extend radially outward from valve bore 64 to bolt outer annular advance groove 90 such that bolt advance passages 92 open into bolt inner annular advance groove 91. Bolt inner annular advance groove 91 has a width $W_{91}$ in the direction of camshaft axis 16 and bolt advance passages 92 each have a width $W_{92}$ in the direction of camshaft axis 16 such that width $W_{92}$ is greater than width $W_{91}$. In this way, bolt advance passages 92 preferably extend past bolt inner annular advance groove 91 in each direction of camshaft axis 16, i.e. left and right as oriented in FIG. 14, thereby causing bolt inner annular advance groove 91 and bolt advance passages 92 together to form advance metering edges which interact with valve spool 30 as will be described in greater detail later. Bolt advance passages 92 preferably extend past bolt inner annular advance groove 91 by at least 10% of width $W_{91}$ in each direction of camshaft axis 16 and preferably by between 10% and 25% of width $W_{91}$ to be effective. It is important to emphasize that bolt advance passages 92 extend to valve bore 64 by virtue of width $W_{92}$ being greater than width $W_{91}$. While bolt advance passages 92 have been illustrated as extending axially past bolt inner annular advance groove 91 in each direction of camshaft axis 16 by equal amounts, it should now be understood that bolt advance passages 92 could alternatively extend past bolt inner annular advance groove 91 further in one direction of camshaft axis 16 than in the other direction of camshaft axis 16. Also alternatively, bolt advance passages 92 could extend past bolt inner annular advance groove 91 in only one direction of camshaft axis 16. Bolt outer annular advance groove 90 is spaced axially apart from bolt supply passages 74 and bolt annular lock pin groove 84 such that bolt annular lock pin groove 84 is axially between bolt supply passages 74 and bolt outer annular advance groove 90. Bolt outer annular advance groove 90 is aligned with a rotor annular advance groove 94 which extends radially outward from rotor central through bore 40 such that rotor advance passages 56 extend from rotor annular advance groove 94 to advance chambers 42. In this way, fluid communication is provided between valve bore 64 and advance chambers 42.

Camshaft phaser attachment bolt 28 also includes a bolt outer annular retard groove 96 on the outer periphery of camshaft phaser attachment bolt 28, a bolt inner annular retard groove 97 which extends radially outward from valve bore 64 and surrounds camshaft axis 16 coaxial with valve bore 64, and bolt retard passages 98 which extend radially outward from valve bore 64 to bolt outer annular retard groove 96 such that bolt retard passages 98 open into bolt inner annular retard groove 97. Bolt inner annular retard groove 97 has a width $W_{97}$ in the direction of camshaft axis 16 and bolt retard passages 98 each have a width $W_{98}$ in the direction of camshaft axis 16 such that width $W_{98}$ is greater than width $W_{97}$. In this way, bolt retard passages 98 preferably extend past bolt inner annular retard groove 97 in each direction of camshaft axis 16, i.e. left and right as oriented in FIG. 14, thereby causing bolt inner annular retard groove 97 and bolt retard passages 98 together to form retard metering edges which interact with valve spool 30 as will be described in greater detail later. Bolt retard passages 98 preferably extend past bolt inner annular retard groove 97 by at least 10% of width $W_{97}$ in each direction of camshaft axis 16 and preferably by between 10% and 25% of width $W_{97}$ to be effective. It is important to emphasize that bolt retard passages 98 extend to valve bore 64 by virtue of width $W_{98}$ being greater than width $W_{97}$. While bolt retard passages 98 have been illustrated as extending axially past bolt inner annular retard groove 97 in each direction of camshaft axis 16 by equal amounts, it should now be understood that bolt retard passages 98 could alternatively extend past bolt inner annular retard groove 97 further in one direction of camshaft axis 16 than in the other direction of camshaft axis 16. Also alternatively, bolt retard passages 98 could extend past bolt inner annular retard groove 98 in only one direction of camshaft axis 16. Bolt outer annular retard groove 96 is spaced axially apart from bolt outer annular advance groove 90 such that bolt outer annular advance groove 90 is axially between bolt annular lock pin groove 84 and bolt outer annular retard groove 96. Bolt outer annular retard groove 96 is aligned with a rotor annular retard groove 100 which extends radially outward from rotor central through bore 40 such that rotor retard passages 58 extend from rotor annular retard groove 100 to retard chambers 44. In this way, fluid communication is provided between valve bore 64 and retard chambers 44.

Valve spool 30 is moved axially along camshaft axis 16 within valve bore 64 of camshaft phaser attachment bolt 28 by an actuator 102 and a valve spring 104 to achieve desired operational states of camshaft phaser 12 by opening and closing bolt supply passages 74, bolt lock pin passages 86, bolt inner annular advance groove 91, bolt advance passages 92, bolt inner annular retard groove 97, and bolt retard passages 98 as will now be described. Valve spool 30 includes a valve spool bore 106 extending axially thereinto from the end of valve spool 30 that is proximal to camshaft 14. An insert 108 is disposed within valve spool bore 106 such that insert 108 defines a phasing volume 110 and a venting volume 112 such that phasing volume 110 is substantially fluidly segregated from venting volume 112, i.e. phasing volume 110 does not communicate with venting volume 112. Phasing check valve 62 is disposed within phasing volume 110 as will be described in greater detail later. By way of non-limiting example only, insert 108 may be net-formed by plastic injection molding and may be easily inserted within valve spool bore 106 from the end of valve spool bore 106 that is proximal to valve spring 104 prior to valve spool 30 being inserted into valve bore 64 of camshaft phaser attachment bolt 28. In this way, phasing volume 110 and venting volume 112 are easily and economically formed.

Valve spool 30 also includes a supply land 114 which is sized to fit within valve bore 64 in a close sliding relationship such that oil is substantially prevented from passing between the interface between supply land 114 and valve bore 64 while allowing valve spool 30 to be displaced axially within valve bore 64 substantially uninhibited.

Valve spool 30 also includes a spool annular supply groove 116 that is axially adjacent to supply land 114. A spool supply passage 118*a* and a spool supply passage 118*b* are provided such that spool supply passage 118*a* and spool supply passage 118*b* each extend radially inward from spool annular supply groove 116 to phasing volume 110 within valve spool bore 106 and such that spool supply passage 118*a* is diametrically opposed to spool supply passage 118*b*. Spool supply passage 118*a* and spool supply passage 118*b* are both preferably slots which extend in a circumferential direction about camshaft axis 16 further than in the direction of camshaft axis 16. A supply check valve 120 is disposed within phasing volume 110, as will be described in greater detail later, in order to allow oil to enter phasing volume 110 from spool supply passage 118*a* and from spool supply passage 118*b* while substantially preventing oil from exiting phasing volume 110 to spool supply passage 118*a* and to spool supply passage 118*b*.

Valve spool 30 also includes a lock pin land 122 that is axially adjacent to spool annular supply groove 116. Lock pin land 122 is sized to fit within valve bore 64 in a close sliding relationship such that oil is substantially prevented from passing between the interface between lock pin land 122 and valve bore 64 while allowing valve spool 30 to be displaced axially within valve bore 64 substantially uninhibited. Lock pin land 122 is axially divided by a spool annular lock pin groove 124 such that a spool lock pin passage 126 (best visible in FIG. 11) extends radially inward from spool annular lock pin groove 124 to venting volume 112 within valve spool bore 106, thereby providing fluid communication between spool annular lock pin groove 124 and venting volume 112.

Valve spool 30 also includes a spool annular advance groove 128 that is axially adjacent to lock pin land 122. A spool advance passage 130*a* and a spool advance passage 130*b* are provided such that spool advance passage 130*a* and spool advance passage 130*b* extend radially inward from spool annular advance groove 128 to phasing volume 110 within valve spool bore 106 in order to provide fluid communication between spool annular advance groove 128 and phasing volume 110. Spool advance passage 130*a* is diametrically opposed to spool advance passage 130*b* and spool advance passage 130*a* and spool advance passage 130*b* are both preferably slots which extend in a circumferential direction about camshaft axis 16 further than in the direction of camshaft axis 16.

Valve spool 30 also includes an advance land 131 that is axially adjacent to spool annular advance groove 128. Advance land 131 is sized to fit within valve bore 64 in a close sliding relationship such that oil is substantially prevented from passing between the interface between advance land 131 and valve bore 64 while allowing valve spool 30 to be displaced axially within valve bore 64 substantially uninhibited.

Valve spool 30 also includes a spool annular recirculation groove 132 that is axially adjacent to advance land 131. A spool recirculation passage 134*a* and a spool recirculation passage 134*b* are provided such that spool recirculation passage 134*a* and spool recirculation passage 134*b* each extend radially inward from spool annular recirculation groove 132 to phasing volume 110 within valve spool bore 106 and such that spool recirculation passage 134*a* is diametrically opposed to spool recirculation passage 134*b*. Spool recirculation passage 134*a* and spool recirculation passage 134*b* are both preferably slots which extend in a circumferential direction about camshaft axis 16 further than in the direction of camshaft axis 16. Phasing check valve 62 is located in phasing volume 110 in order to allow oil to enter phasing volume 110 from spool recirculation passage 134 while substantially preventing oil from exiting phasing volume 110 to spool recirculation passage 134*a* and to spool recirculation passage 134*b*.

Valve spool 30 also includes a retard land 138 that is axially adjacent to spool annular recirculation groove 132. Retard land 138 is sized to fit within valve bore 64 in a close sliding relationship such that oil is substantially prevented from passing between the interface between retard land 138 and valve bore 64 while allowing valve spool 30 to be displaced axially within valve bore 64 substantially uninhibited.

Valve spool 30 also includes a spool annular retard groove 140 that is axially adjacent to retard land 138. A spool retard passage 142*a* and a spool retard passage 142*b* are provided such that spool retard passage 142*a* and spool retard passage 142*b* extend radially inward from spool annular retard groove 140 to phasing volume 110 within valve spool bore 106 in order to provide fluid communication between spool annular retard groove 140 and phasing volume 110. Spool retard passage 142*a* is diametrically opposed to spool retard passage 142*b* and spool retard passage 142*a* and spool retard passage 142*b* are both preferably slots which extend in a circumferential direction about camshaft axis 16 further than in the direction of camshaft axis 16.

Valve spool 30 also includes an end land 144 that is axially adjacent to spool annular retard groove 140. End land 144 is sized to fit within valve bore 64 in a close sliding relationship such that oil is substantially prevented from passing between the interface between end land 144 and valve bore 64 while allowing valve spool 30 to be displaced axially within valve bore 64 substantially uninhibited.

Valve spool 30 also includes vent passages 146 which extend radially outward from venting volume 112, thereby allowing oil within venting volume 112 to be vented to valve bore 64 and out of camshaft phaser 12 where it may be drained back to oil source 76. Alternatively, a passage could be formed in camshaft phaser attachment bolt 28 which extends from valve bore 64 to a drain passage in camshaft 14 in order to vent oil within venting volume 112 where it may be drained back to oil source 76.

Figure 5A:
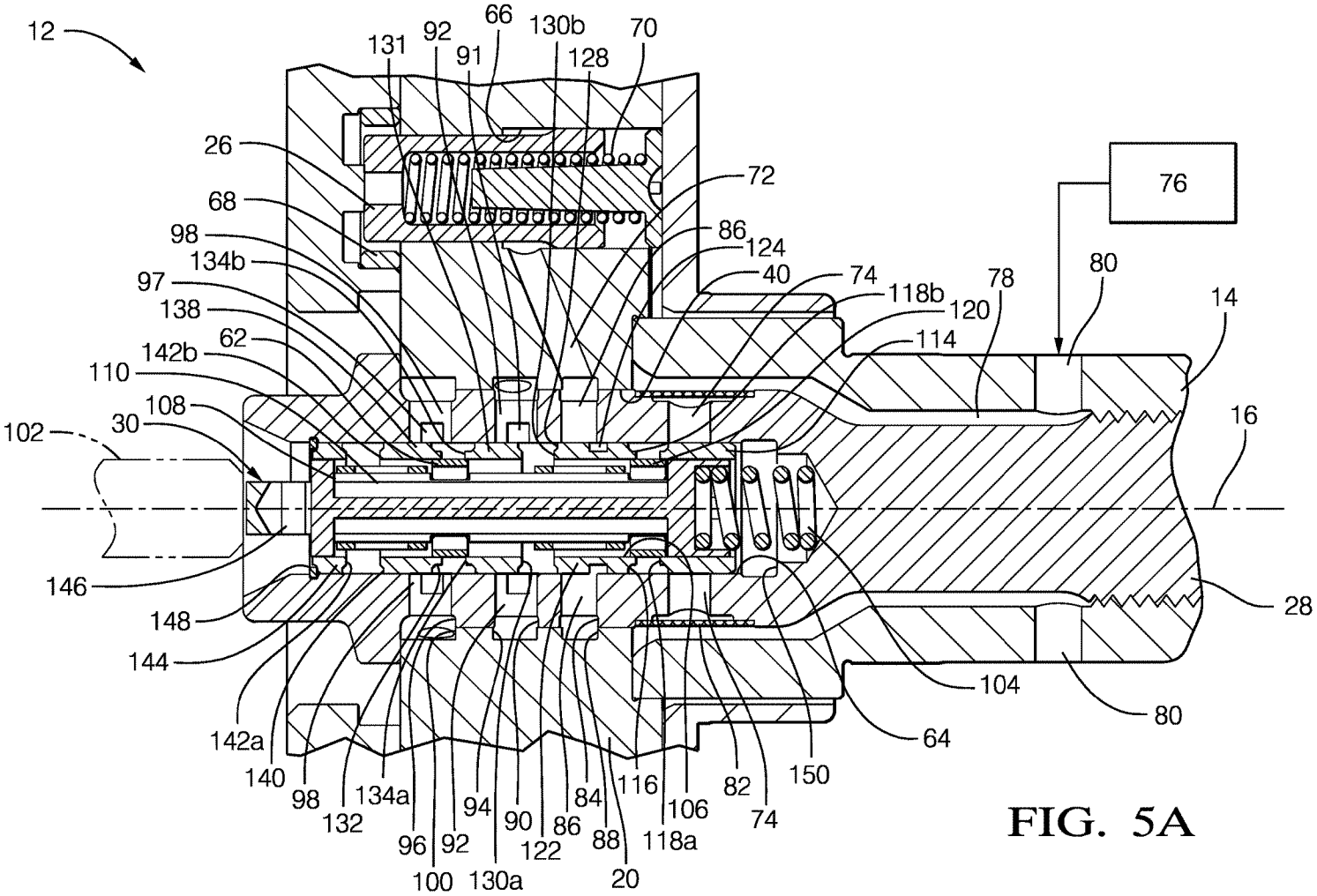
FIG. 5A is an enlarged portion of FIG. 4 showing a valve spool of the camshaft phaser in a default position with a lock pin engaged with a lock pin seat.
Figure 5B:
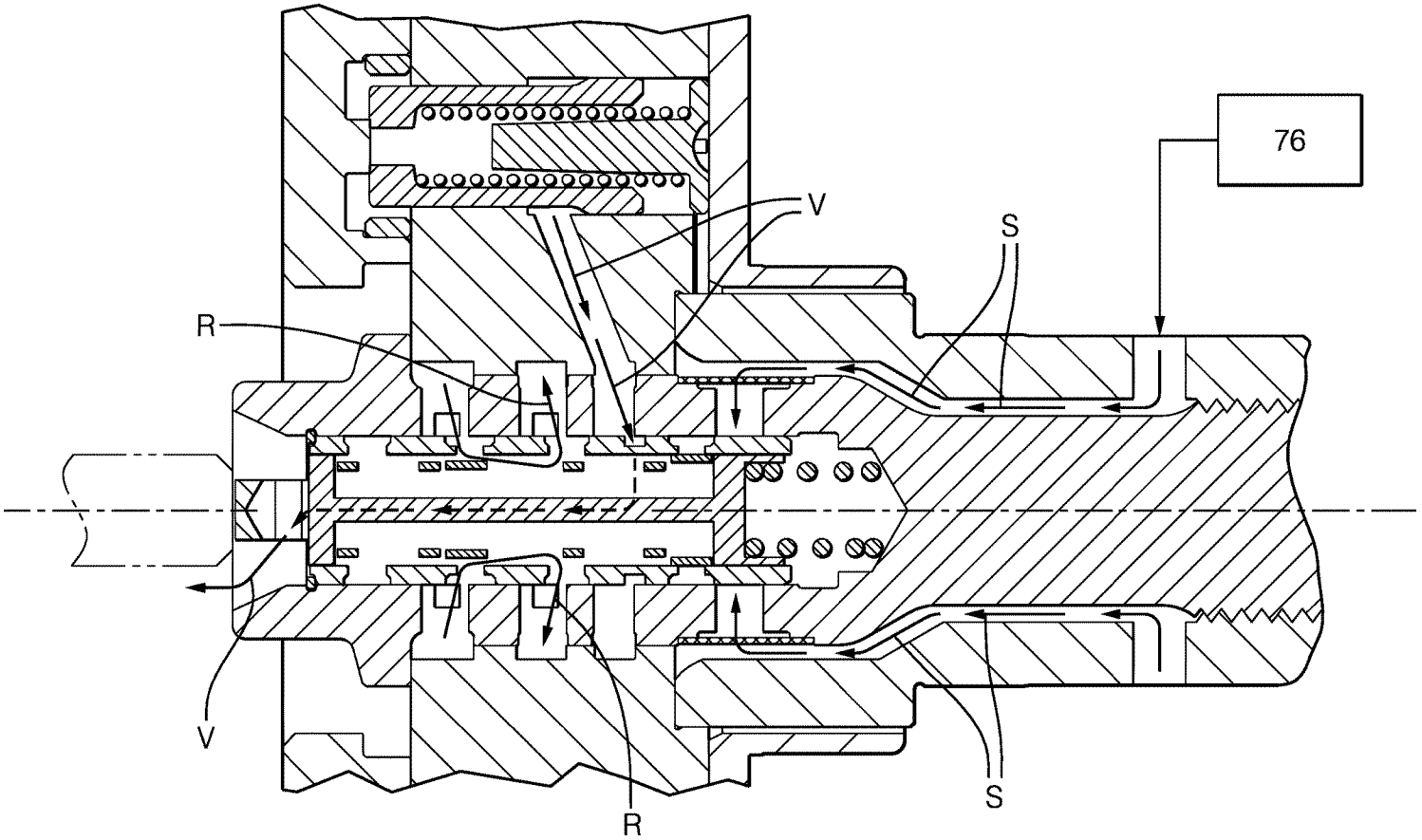
FIG. 5B is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 102 as shown in FIGS. 5A and 5B, valve spring 104 urges valve spool 30 in a direction toward actuator 102 until valve spool 30 axially abuts a first stop member 148, which may be, by way of non-limiting example only, a snap ring within a snap ring groove extending radially outward from valve bore 64. In the default position, supply land 114 is positioned to block bolt supply passages 74, thereby preventing pressurized oil from being supplied to phasing volume 110 from oil source 76. Also in the default position, lock pin land 122 is positioned to align spool annular lock pin groove 124 with bolt lock pin passages 86, thereby allowing oil to be vented from lock pin bore 66 via rotor lock pin passage 72, rotor annular lock pin groove 88, bolt annular lock pin groove 84, bolt lock pin passages 86, spool annular lock pin groove 124, spool lock pin passage 126 (best visible in FIG. 11), venting volume 112, and vent passages 146 and consequently allowing lock pin spring 70 to urge lock pin 26 toward front cover 24. In the default position, lock pin land 122 also blocks fluid communication between bolt lock pin passages 86 and phasing volume 110. Also in the default position, advance land 131 is positioned to permit fluid communication between bolt inner annular advance groove 91/bolt advance passages 92 and phasing volume 110 via spool annular advance groove 128 and spool advance passages 130*a*, 130*b* while retard land 138 is positioned to permit fluid communication between bolt inner annular retard groove 97/bolt retard passages 98 and phasing volume 110 via spool annular recirculation groove 132, spool recirculation passages 134*a*, 134*b*, and phasing check valve 62. However, fluid communication is prevented from bolt inner annular advance groove 91/bolt advance passages 92 directly to spool annular recirculation groove 132 and fluid communication is prevented from bolt inner annular retard groove 97/bolt retard passages 98 directly to spool annular retard groove 140. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt outer annular retard groove 96, bolt retard passages 98, bolt inner annular retard groove 97, spool annular recirculation groove 132, spool recirculation passages 134*a*, 134*b*, phasing check valve 62, phasing volume 110, spool advance passages 130*a*, 130*b*, spool annular advance groove 128, bolt inner annular advance groove 91, bolt advance passages 92, bolt outer annular advance groove 90, rotor annular advance groove 94, and rotor advance passages 56. However, torque reversals of camshaft 14 that tend to pressurize oil within advance chambers 42 are prevented from venting oil from advance chambers 42 because phasing check valve 62 prevents oil from being supplied to retard chambers 44. Consequently, in the default position, torque reversals of camshaft 14 cause rotor 20 to rotate relative to stator 18 to cause a retard in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. In FIG. 5B, the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18. It should be noted that FIG. 5B shows phasing check valve 62 being opened, but phasing check valve 62 may also be closed depending on the direction of the torque reversion of camshaft 14 at a particular time.

Figure 6A:
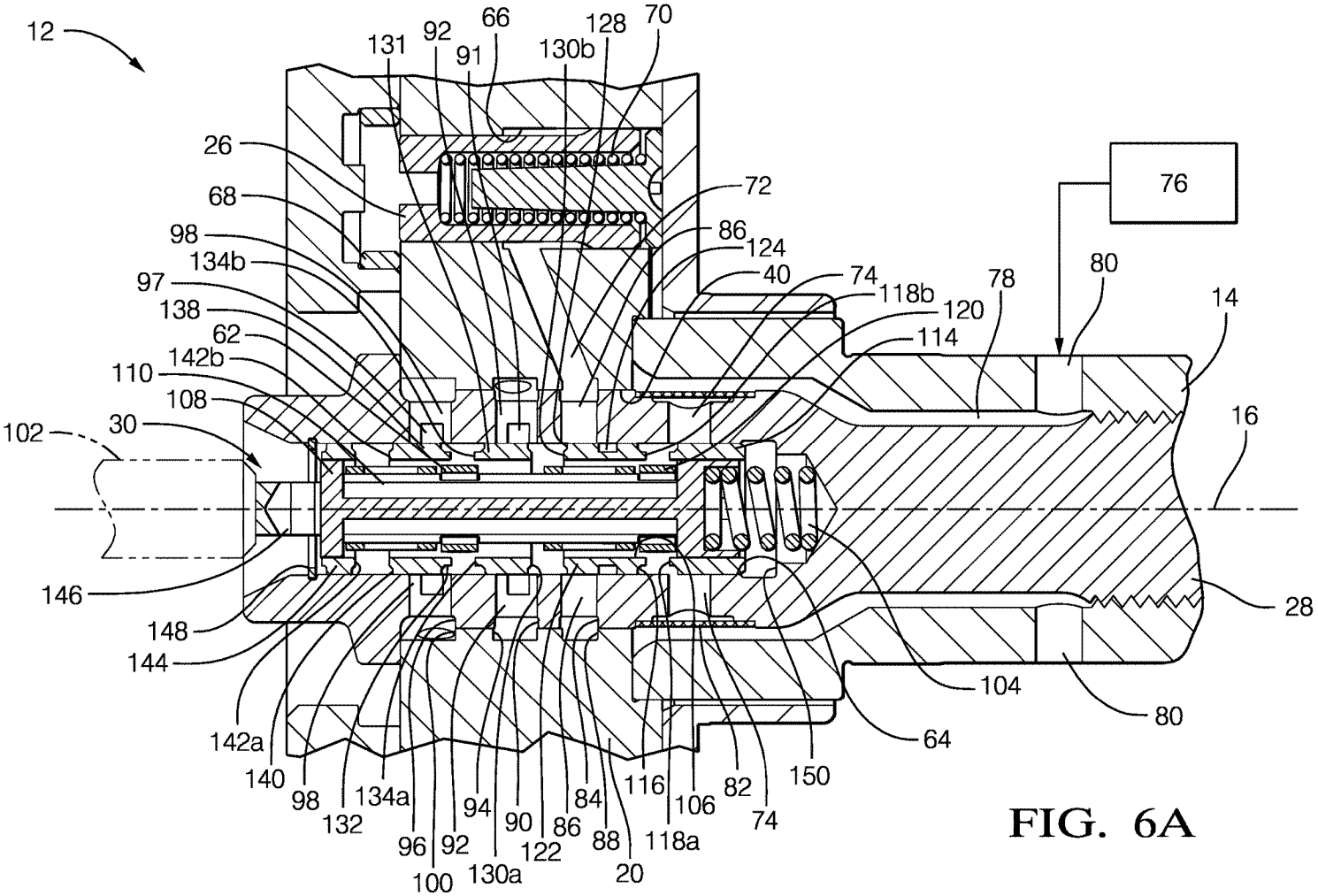
FIG. 6A is the view of FIG. 5A now shown with the valve spool in a retard position now with the lock pin retracted from the lock pin seat.
Figure 6B:
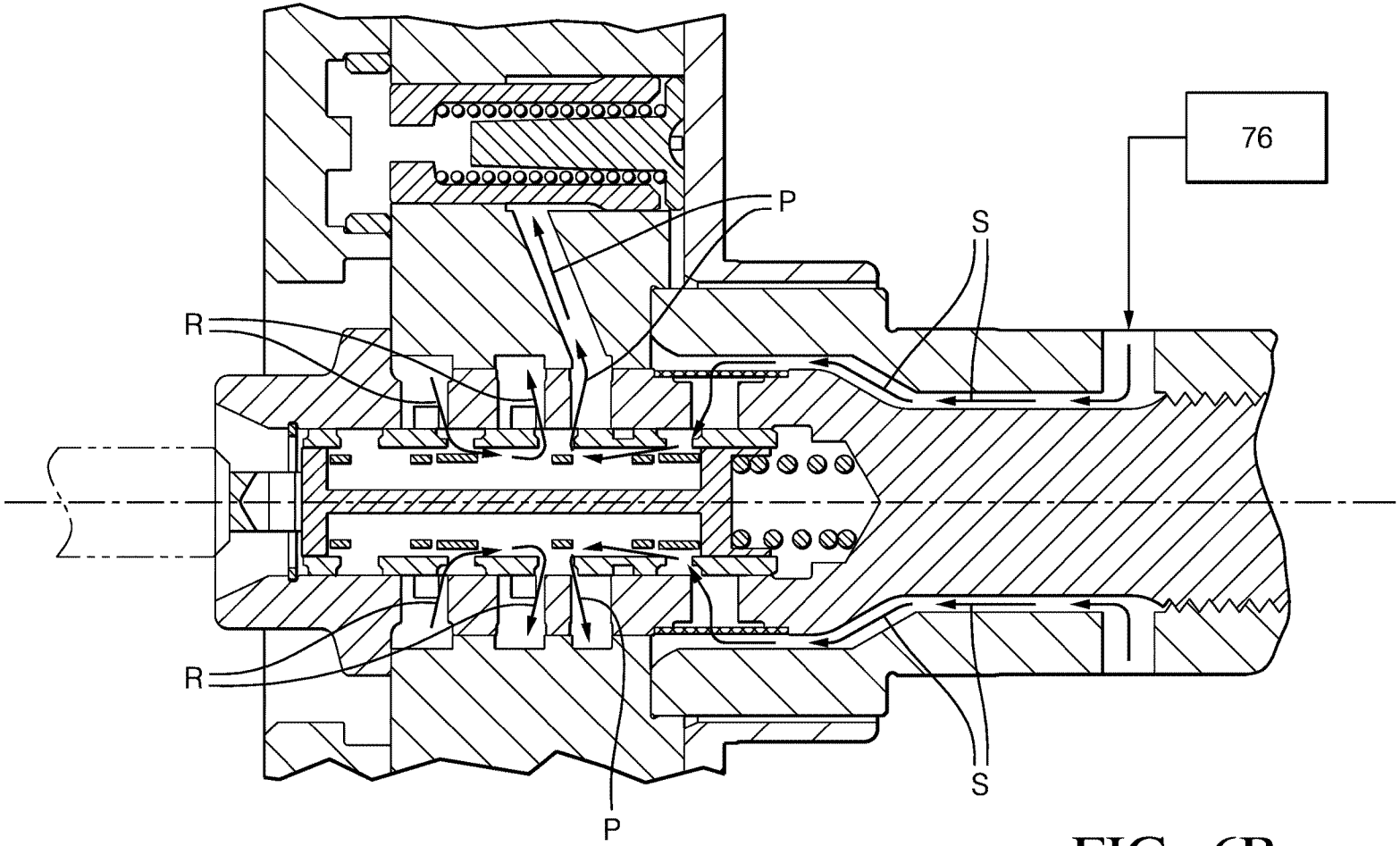
FIG. 6B is the view of FIG. 6A shown with reference numbers removed and arrows added in order to clearly show the path of travel of oil.

In a retard position, when an electric current of a first magnitude is supplied to actuator 102 as shown in FIGS. 6A and 6B, actuator 102 urges valve spool 30 in a direction toward valve spring 104 thereby causing valve spring 104 to be compressed slightly. In the retard position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the retard position, lock pin land 122 is positioned to prevent fluid communication between bolt lock pin passages 86 and spool annular lock pin groove 124, thereby preventing oil from being vented from lock pin bore 66. In the retard position, lock pin land 122 also opens fluid communication between bolt lock pin passages 86 and phasing volume 110, thereby allowing pressurized oil to be supplied to lock pin bore 66 via spool advance passages 130*a*, 130*b*, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. It should be noted that by supplying oil to lock pin bore 66 from phasing volume 110, a separate dedicated supply for retracting lock pin 26 from lock pin seat 68 is not required. Also in the retard position, advance land 131 is positioned to permit fluid communication between bolt inner annular advance groove 91/bolt advance passages 92 and phasing volume 110 via spool annular advance groove 128 and spool advance passages 130*a*, 130*b* while retard land 138 is positioned to permit fluid communication between bolt inner annular retard groove 97/bolt retard passages 98 and phasing volume 110 via spool annular recirculation groove 132, spool recirculation passages 134*a*, 134*b*, and phasing check valve 62. However, fluid communication is prevented from bolt inner annular advance groove 91/bolt advance passages 92 directly to spool annular recirculation groove 132 and fluid communication is prevented from bolt inner annular retard groove 97/bolt retard passages 98 directly to spool annular retard groove 140. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt outer annular retard groove 96, bolt retard passages 98, bolt inner annular retard groove 97, spool annular recirculation groove 132, spool recirculation passages 134*a*, 134*b*, phasing check valve 62, phasing volume 110, spool advance passages 130*a*, 130*b*, spool annular advance groove 128, bolt inner annular advance groove 91, bolt advance passages 92, bolt outer annular advance groove 90, rotor annular advance groove 94, and rotor advance passages 56. However, torque reversals of camshaft 14 that tend to pressurize oil within advance chambers 42 are prevented from venting oil from advance chambers 42 because phasing check valve 62 prevents oil from being supplied to retard chambers 44. Consequently, in the retard position, torque reversals of camshaft 14 cause rotor 20 to rotate relative to stator 18 to cause a retard in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. In FIG. 6B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 6B shows phasing check valve 62 being opened, but phasing check valve 62 may also be closed depending on the direction of the torque reversion of camshaft 14 at a particular time. It should also be noted that supply check valve 120 is shown open in FIG. 6B, but may typically remain closed unless lock pin 26 is in the process of being retracted from lock pin seat 68.

Figure 7A:
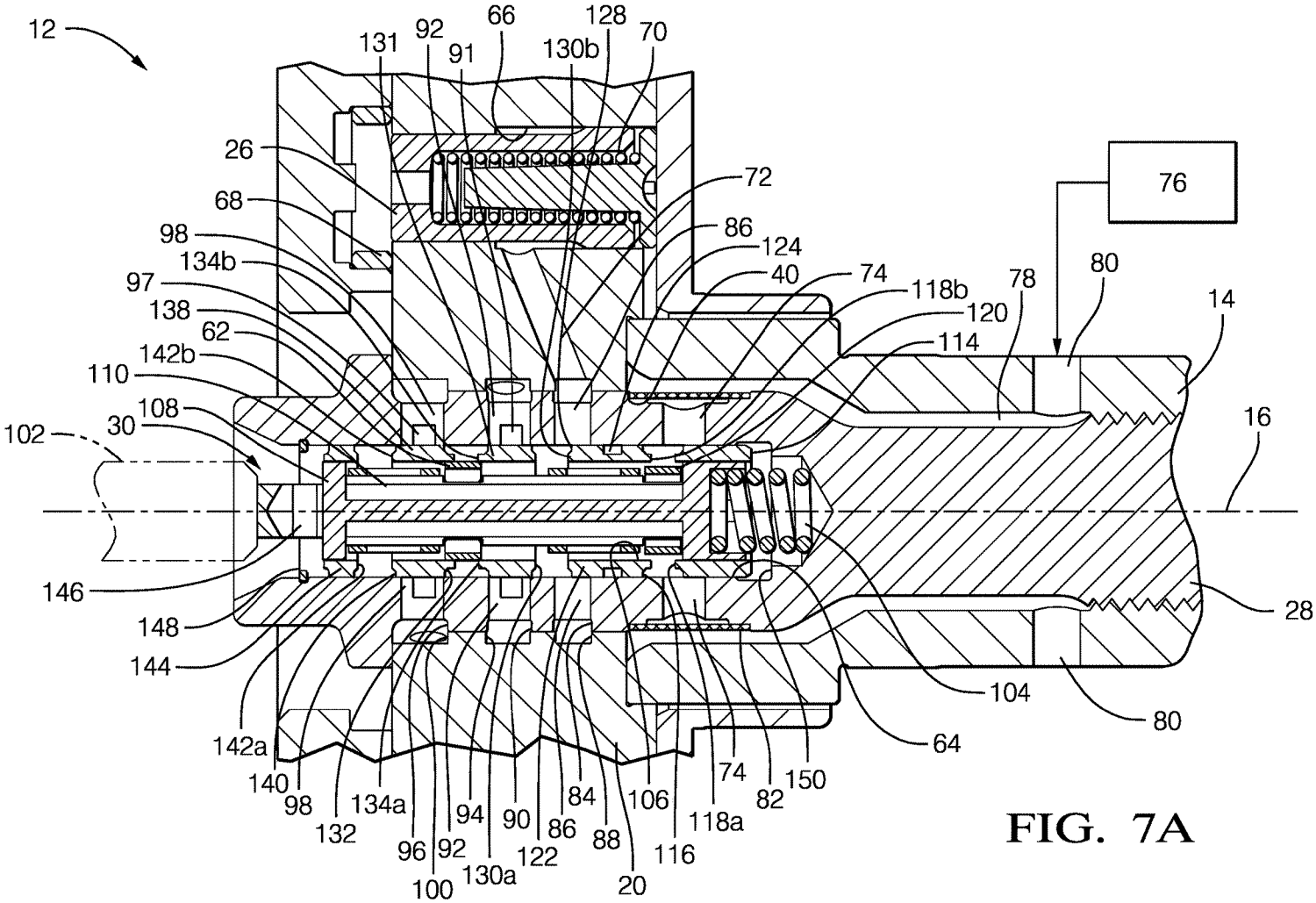
FIG. 7A is the view of FIG. 5A now shown with the valve spool in a hold position now with the lock pin retracted from the lock pin seat.
Figure 7B:
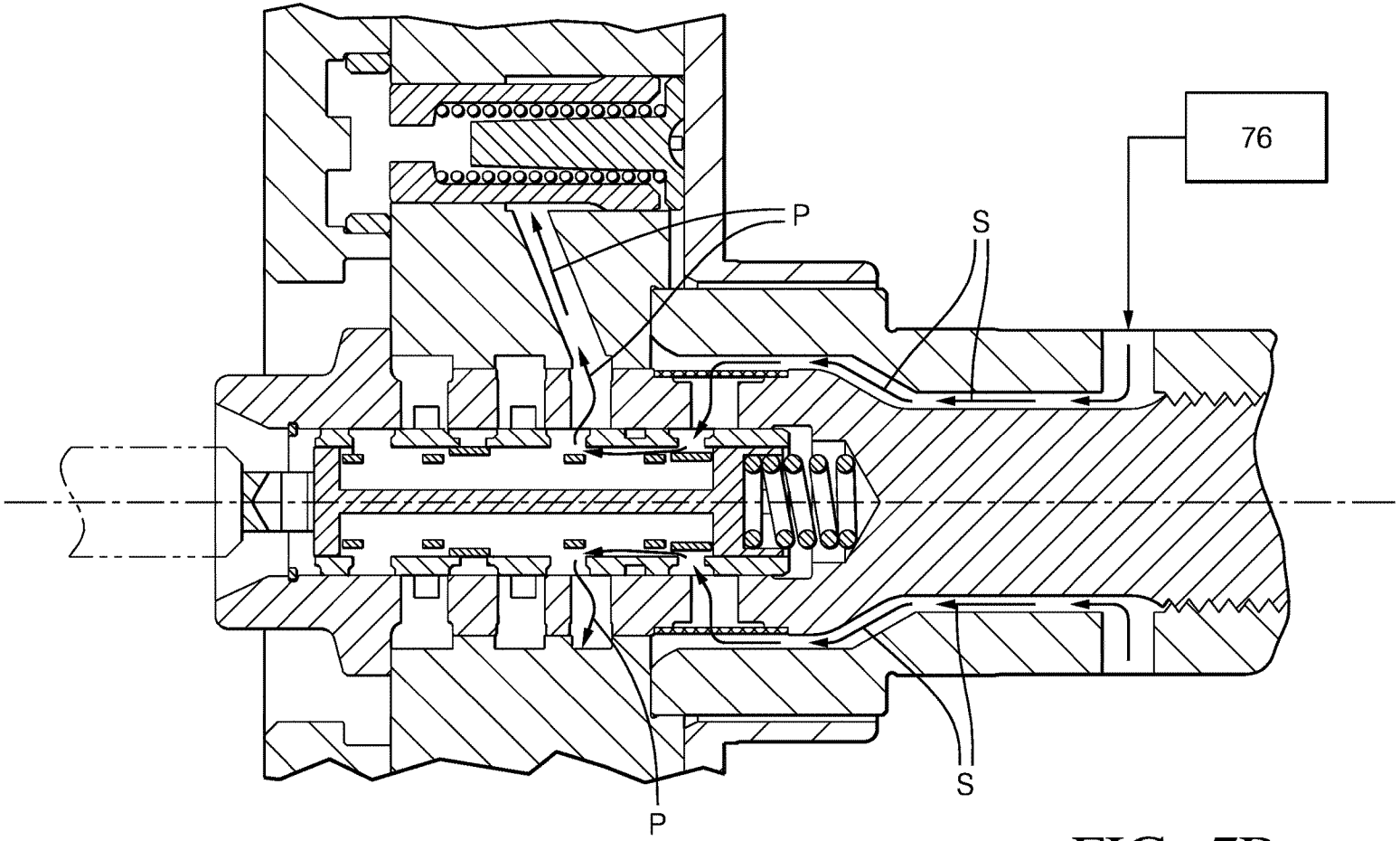
FIG. 7B is the view of FIG. 7A shown with reference numbers removed and arrows added in order to clearly show the path of travel of oil.

In a hold position, when an electric current of a second magnitude is supplied to actuator 102 as shown in FIGS. 7A and 7B, actuator 102 urges valve spool 30 in a direction toward valve spring 104 thereby causing valve spring 104 to be compressed slightly more than in the retard position. In the hold position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the hold position, lock pin land 122 is positioned to prevent fluid communication between bolt lock pin passages 86 and spool annular lock pin groove 124, thereby preventing oil from being vented from lock pin bore 66. In the hold position, lock pin land 122 also opens fluid communication between bolt lock pin passages 86 and phasing volume 110, thereby allowing pressurized oil to be supplied to lock pin bore 66 via spool advance passages 130*a*, 130*b*, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the hold position, advance land 131 is positioned to block direct fluid communication between bolt inner annular advance groove 91/bolt advance passages 92 and spool annular advance groove 128 while providing restricted fluid communication between bolt inner annular advance groove 91/bolt advance passages 92 and spool annular recirculation groove 132. Similarly, in the hold position, retard land 138 is positioned to block direct fluid communication between bolt inner annular retard groove 97/bolt retard passages 98 and spool annular retard groove 140 while providing restricted fluid communication between bolt inner annular retard groove 97/bolt retard passages 98 and spool annular recirculation groove 132. By providing restricted fluid communication between bolt inner annular advance groove 91/bolt advance passages 92 and spool annular recirculation groove 132 and between bolt inner annular retard groove 97/bolt retard passages 98 and spool annular recirculation groove 132, the rotational position of rotor 20 and stator 18 is substantially maintained in the hold position. In FIG. 7B, the reference numbers have been removed for clarity and arrows representing the path of travel of the oil have been included where arrows S represent oil from oil source 76 and arrows P represent oil that is pressurized to retract lock pin 26 from lock pin seat 68. It should be noted that FIG. 7B shows supply check valve 120 being open, but may typically remain closed unless lock pin 26 is in the process of being retracted from lock pin seat 68.

Figure 8A:
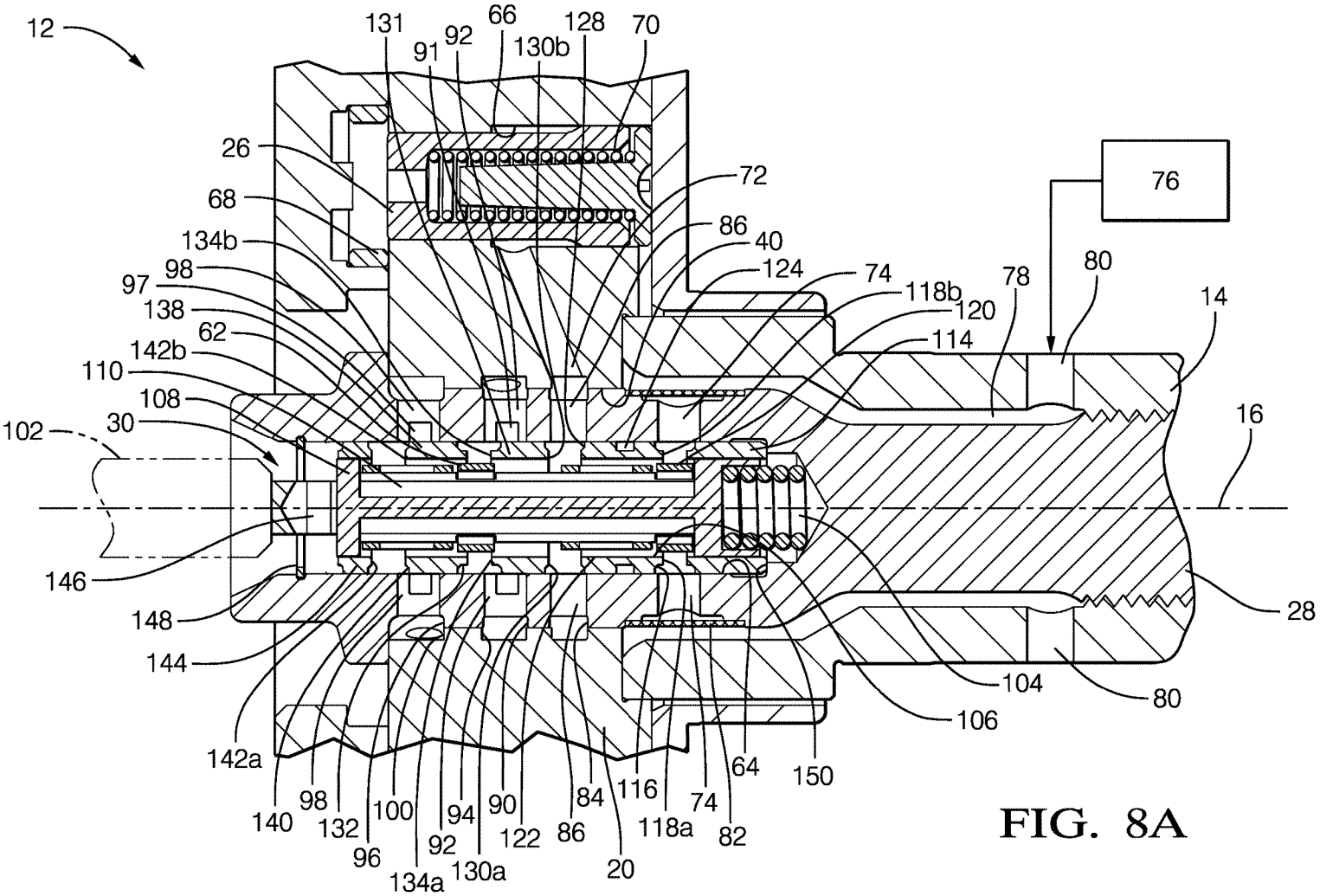
FIG. 8A is the view of FIG. 5A now shown with the valve spool in an advance position now with the lock pin retracted from the lock pin seat.
Figure 8B:
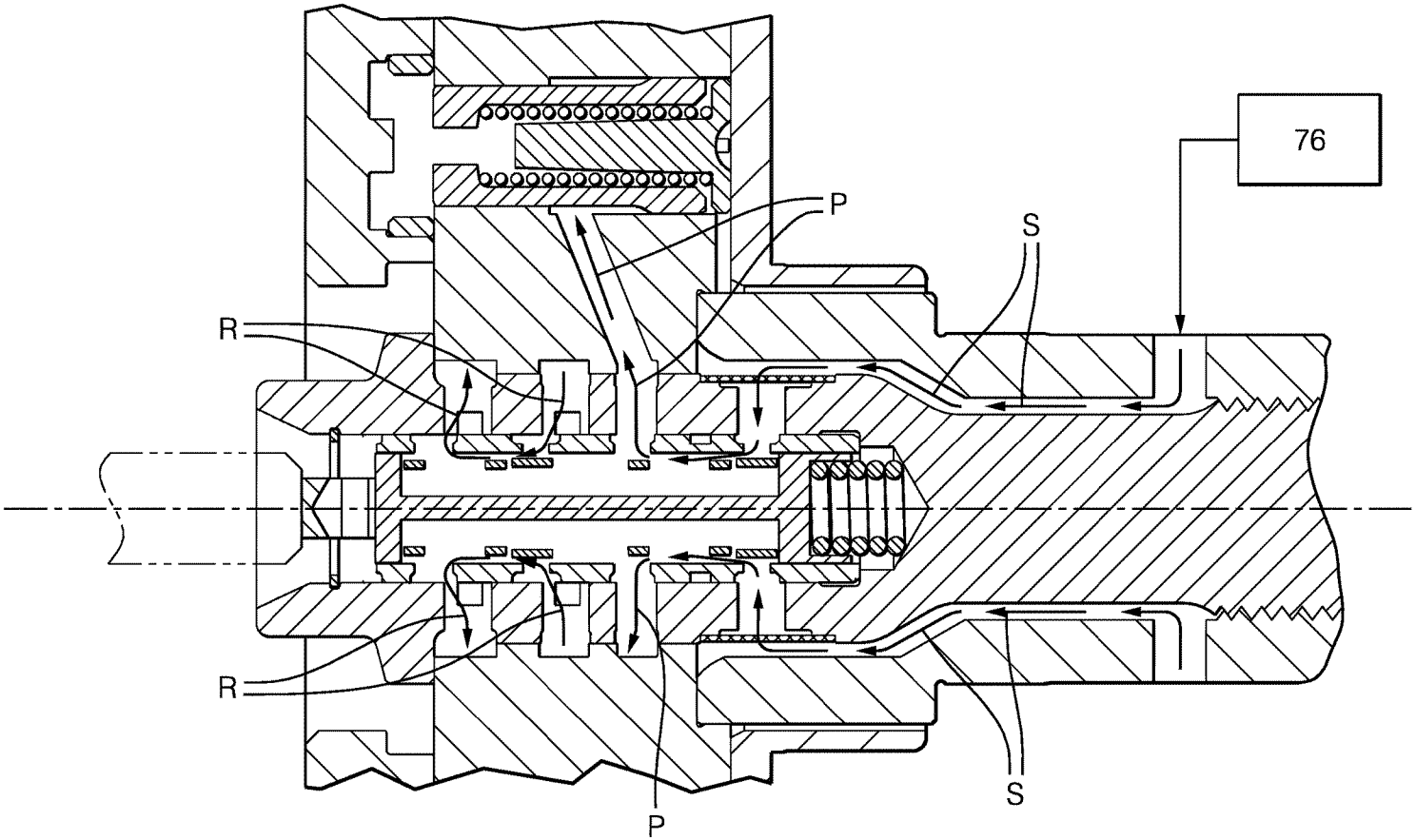
FIG. 8B is the view of FIG. 8A shown with reference numbers removed and arrows added in order to clearly show the path of travel of oil.

In an advance position, when an electric current of a third magnitude is supplied to actuator 102 as shown in FIGS. 8A and 8B, actuator 102 urges valve spool 30 in a direction toward valve spring 104 thereby causing valve spring 104 to be compressed slightly more than in the hold position until valve spool 30 abuts a second stop member 150, which may be, by way of non-limiting example only, a shoulder formed in valve bore 64. In the advance position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the advance position, lock pin land 122 is positioned to prevent fluid communication between bolt lock pin passages 86 and spool annular lock pin groove 124, thereby preventing oil from being vented from lock pin bore 66. In the advance position, lock pin land 122 also opens fluid communication between bolt lock pin passages 86 and phasing volume 110, thereby allowing pressurized oil to be supplied to lock pin bore 66 via spool advance passages 130*a*, 130*b*, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the advance position, advance land 131 is positioned to permit fluid communication between bolt inner annular advance groove 91/bolt advance passages 92 and phasing volume 110 via spool annular recirculation groove 132, spool recirculation passages 134*a*, 134*b*, and phasing check valve 62 while retard land 138 is positioned to permit fluid communication between bolt inner annular retard groove 97/bolt retard passages 98 and phasing volume 110 via spool annular retard groove 140 and spool retard passages 142*a*, 142*b*. However, fluid communication is prevented from bolt inner annular advance groove 91/bolt advance passages 92 directly to spool annular advance groove 128 and fluid communication is prevented from bolt inner annular retard groove 97/bolt retard passages 98 directly to spool annular recirculation groove 132. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt outer annular advance groove 90, bolt advance passages 92, bolt inner annular advance groove 91, spool annular recirculation groove 132, spool recirculation passages 134*a*, 134*b*, phasing check valve 62, phasing volume 110, spool retard passages 142*a*, 142*b*, spool annular retard groove 140, bolt inner annular retard groove 97, bolt retard passages 98, bolt outer annular retard groove 96, rotor annular retard groove 100, and rotor retard passages 58. However, torque reversals of camshaft 14 that tend to pressurize oil within retard chambers 44 are prevented from venting oil from retard chambers 44 because phasing check valve 62 prevents oil from being supplied to advance chambers 42. Consequently, in the advance position, torque reversals of camshaft 14 cause rotor 20 to rotate relative to stator 18 to cause an advance in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. In FIG. 8B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 8B shows phasing check valve 62 being opened, but phasing check valve 62 may also be closed depending on the direction of the torque reversion of camshaft 14 at a particular time. It should also be noted that supply check valve 120 is shown open in FIG. 8B, but may typically remain closed unless lock pin 26 is in the process of being retracted from lock pin seat 68.

Figure 9:
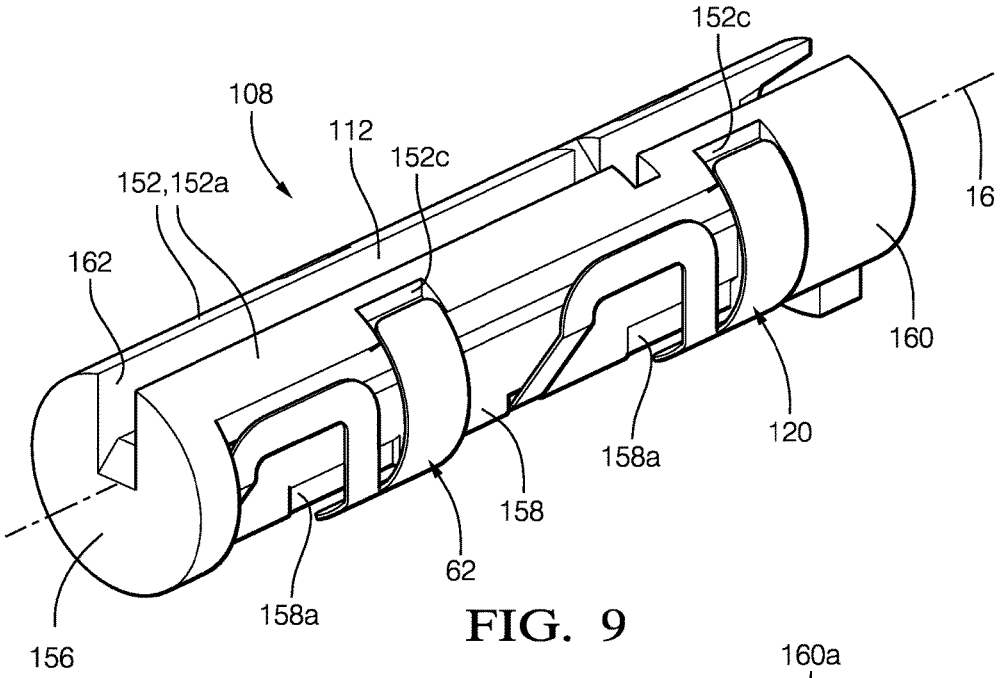
FIGS. 9 and 10 are isometric views of an insert of a valve spool of the camshaft phaser in accordance with the present invention.
Figure 10:
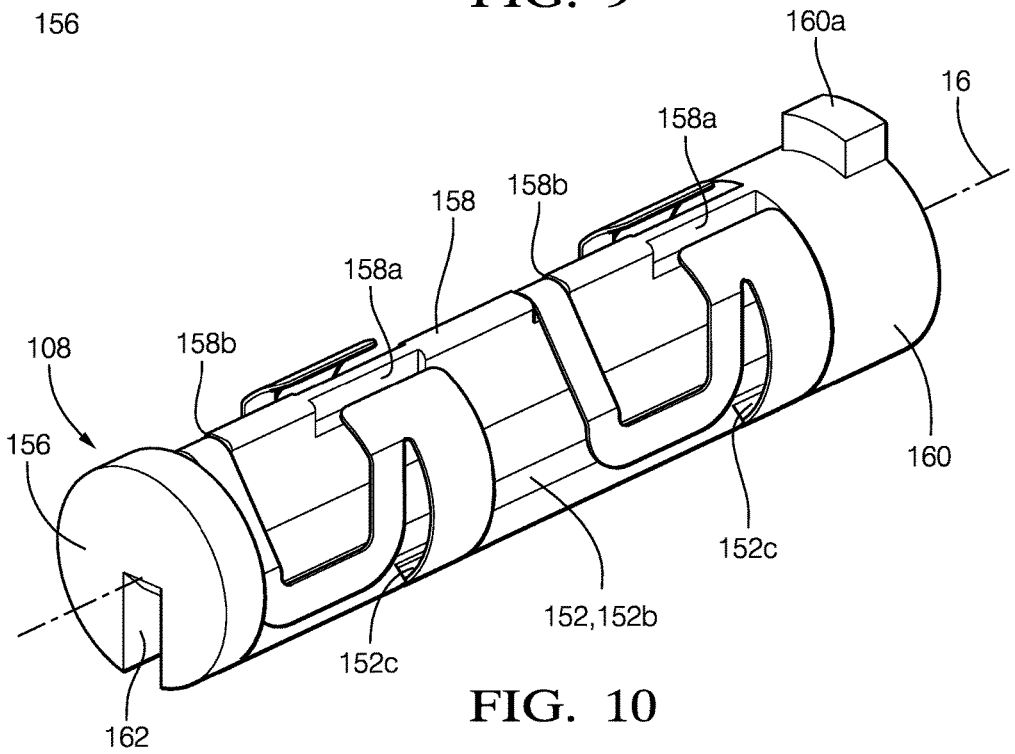
Figure 11:
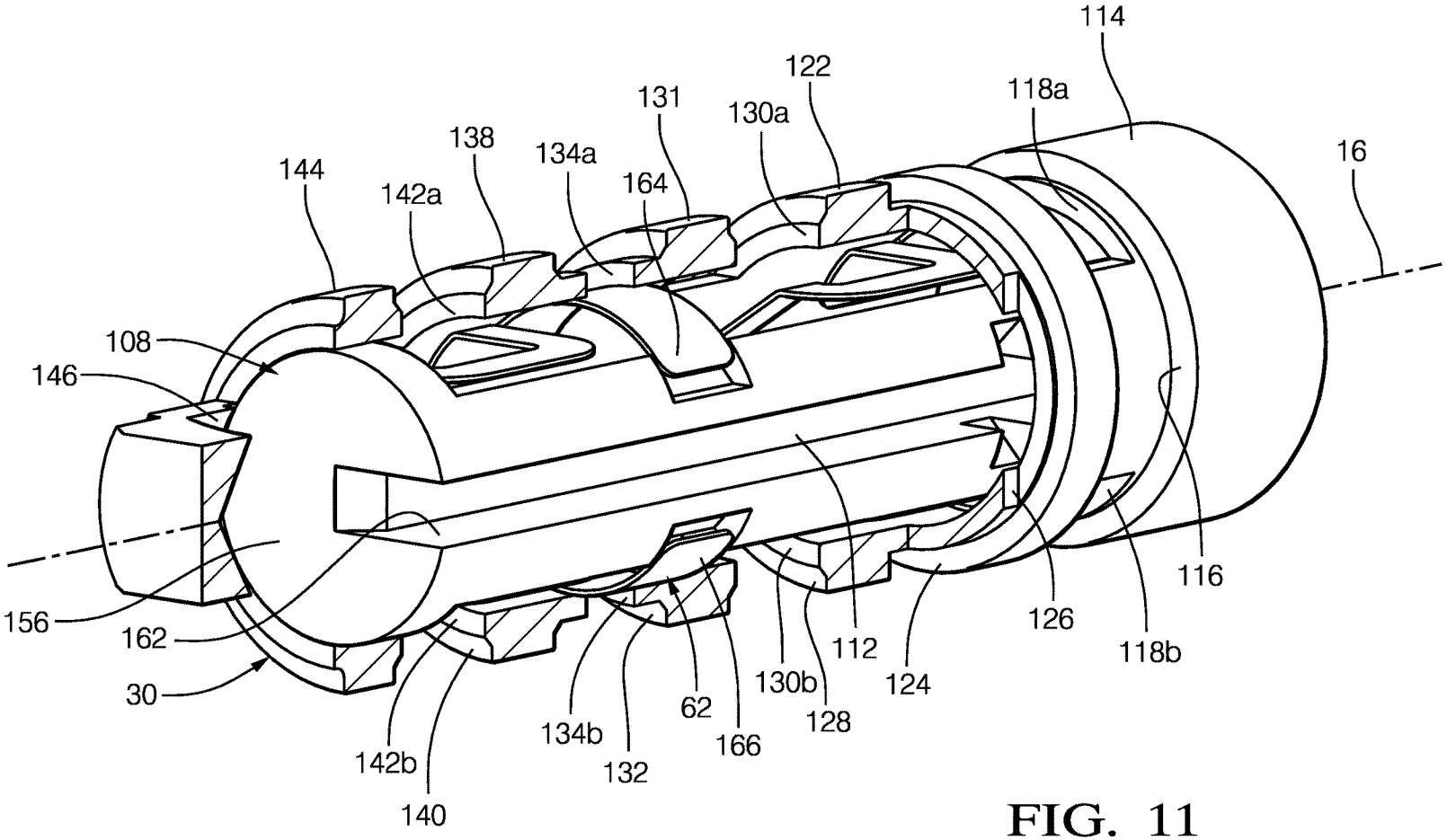
FIGS. 11 and 12 are isometric cross-sectional views of the valve spool and the insert of the camshaft phaser in accordance with the present invention.
Figure 12:
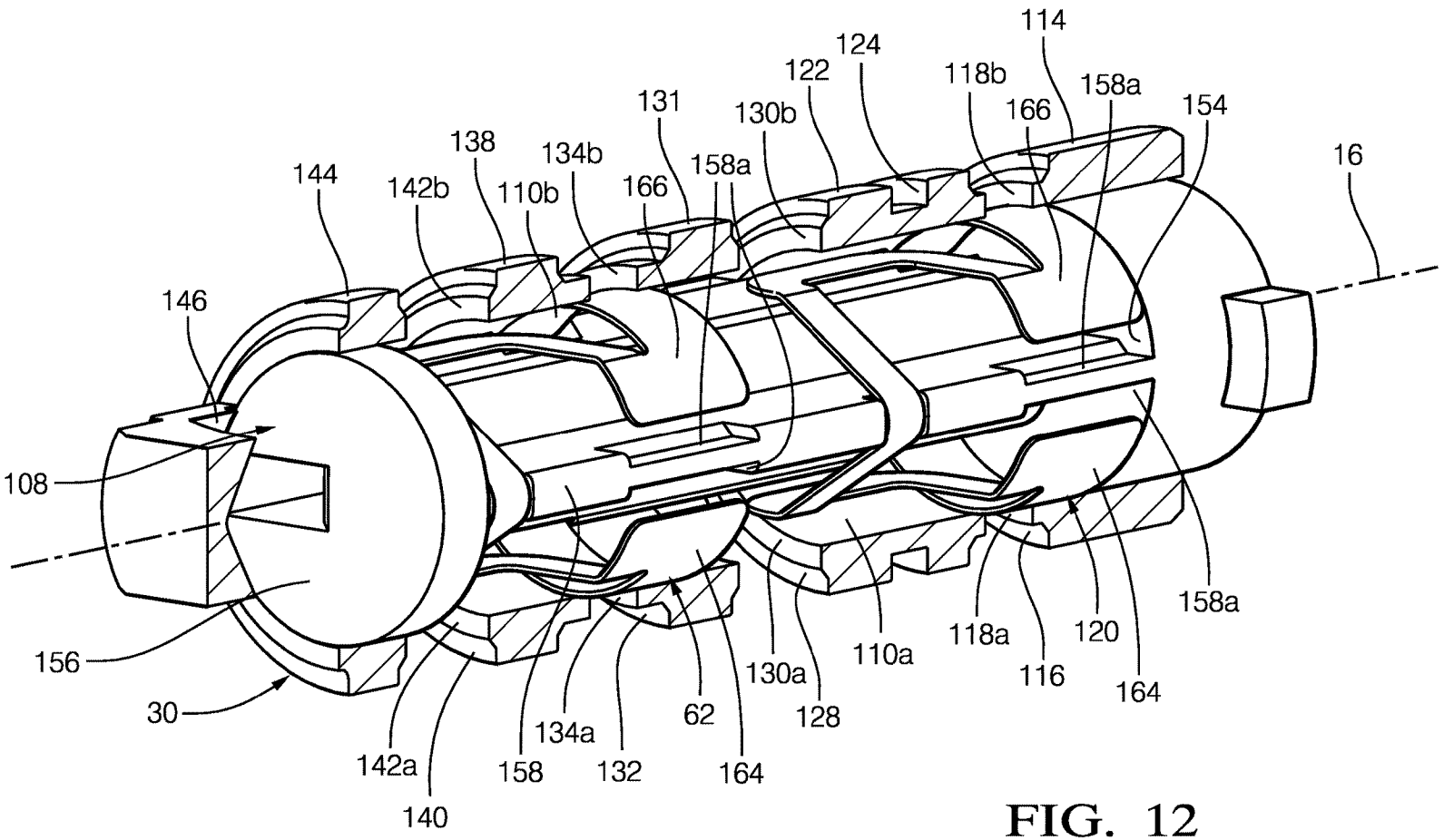

Insert 108 will now be described with particular reference to FIGS. 9-12 where FIGS. 9 and 10 are isometric views of insert 108 and FIGS. 11 and 12 are isometric axial cross-sectional views of valve spool 30 and insert 108. Insert 108 is defined by an insert sidewall 152 which extends axially within valve spool bore 106. A first side 152*a* of insert sidewall 152 faces toward and is contoured to mate sealingly with valve spool bore 106 while a second side 152*b* of insert sidewall 152 defines phasing volume 110 together with valve spool bore 106. Insert sidewall 152 includes insert sidewall recesses 152*c* which extend into second side 152*b* in order to accommodate opening of phasing check valve 62 and supply check valve 120 as will be described in greater detail later. Insert 108 is also defined by an insert first end wall 154 which traverses valve spool bore 106 in a direction substantially perpendicular to camshaft axis 16. Insert 108 is also defined by an insert second end wall 156 which traverses valve spool bore 106 in a direction substantially perpendicular to camshaft axis 16. Insert first end wall 154 and insert second end wall 156 are contoured to mate sealingly with valve spool bore 106, thereby defining phasing volume 110 axially between insert first end wall 154 and insert second end wall 156. Insert sidewall 152 extends axially between insert first end wall 154 and insert second end wall 156, thereby connecting insert first end wall 154 and insert second end wall 156. Insert 108 may include an insert rib 158 which extends axially from insert first end wall 154 to insert second end wall 156 such that insert rib 158 extends from insert sidewall 152 toward valve spool bore 106, thereby bifurcating phasing volume 110 into first phasing volume 110*a* and second phasing volume 110*b*. Insert rib 158 provides support to insert first end wall 154 and insert second end wall 156 in order to resist force created during times when phasing volume 110 is exposed to high pressure. Insert rib 158 may include insert rib recesses 158*a* in order to accommodate opening of phasing check valve 62 and supply check valve 120 as will be described in greater detail later. Two insert rib recesses 158*a* are formed in the face of insert rib 158 that faces toward first phasing volume 110*a* while two insert rib recesses 158*a* are formed in the face of insert rib 158 that faces toward second phasing volume 110*b*. Insert rib 158 may also include insert rib positioning notches 158*b* which position phasing check valve 62 and supply check valve 120 as will be described in greater detail later. Insert rib positioning notches 158*b* extend into the edge of insert rib 158 which faces toward valve spool bore 106 such that insert rib positioning notches 158*b* provide fluid communication between first phasing volume 110*a* and second phasing volume 110*b*, thereby preventing a pressure differential between first phasing volume 110*a* and second phasing volume 110*b*. An insert spring wall 160 extends axially from insert first end wall 154 in a direction that is opposite of insert sidewall 152 such that insert spring wall 160 is hollow in order to receive a portion of valve spring 104 therein. In this way, one end of valve spring 104 mates with insert first end wall 154 and is maintained in a centered relationship about camshaft axis 16 by insert spring wall 160. In order to provide proper orientation of insert 108 within valve spool bore 106, insert spring wall 160 may include an alignment tab 160*a* which is received within a complementary spool alignment notch (not shown) in valve spool 30. An insert slot 162 extends axially along insert 108 such that insert slot 162 extends along insert spring wall 160, insert first end wall 154, first side 152*a* of insert sidewall 152, and insert second end wall 156. In this way, venting volume 112 is defined between insert slot 162 and valve spool bore 106.

Figure 13:
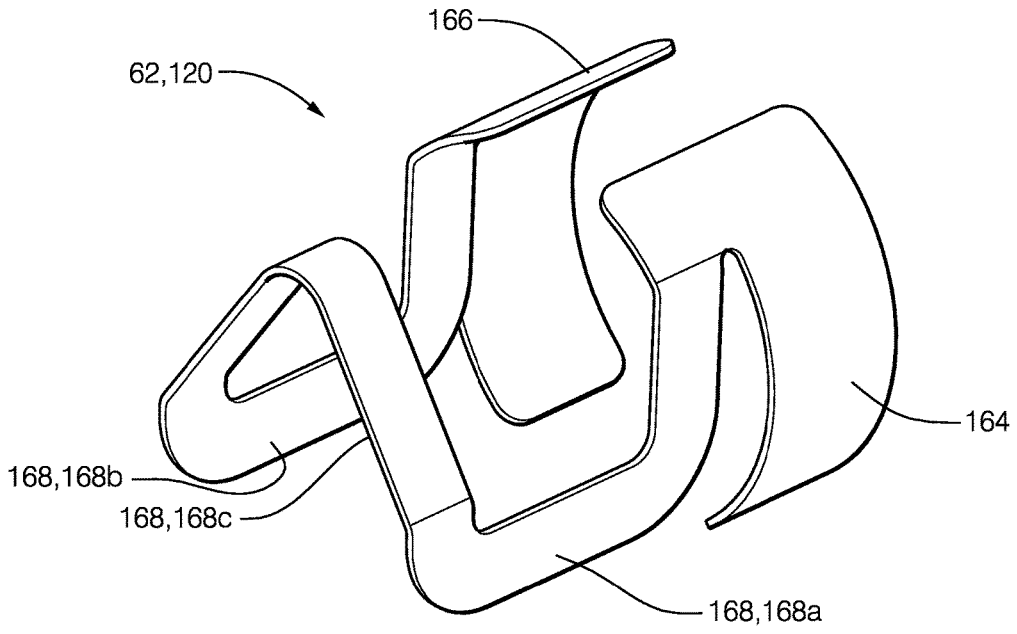
FIG. 13 is an isometric view of a check valve of the camshaft phaser in accordance with the present invention.
Figure 14:
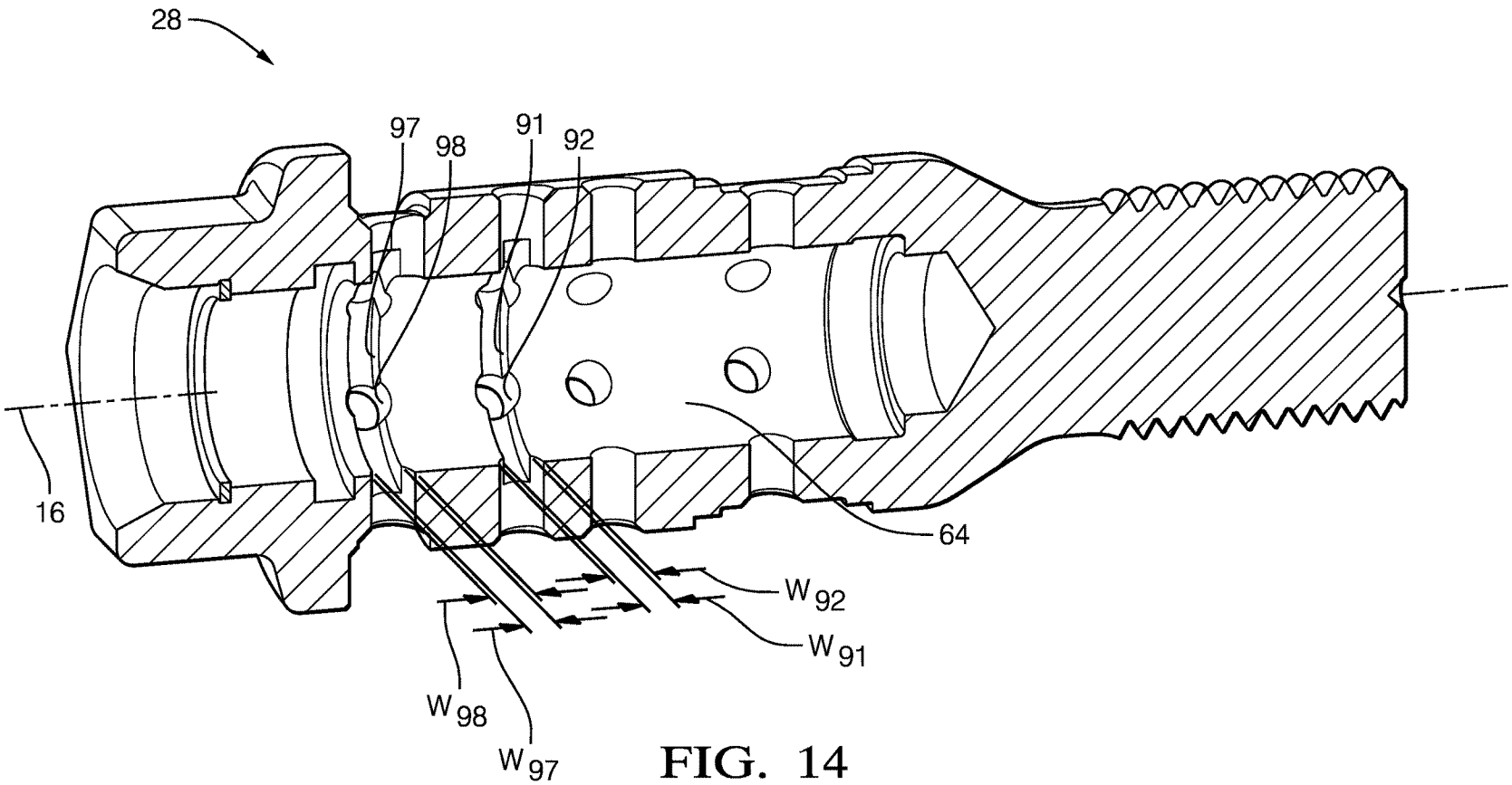
FIG. 14 is an isometric cross-section view of a camshaft phaser attachment bolt in accordance with the present invention which serves as a valve body.

Phasing check valve 62 and supply check valve 120 may be substantially the same and will now be described simultaneously with particular reference to FIG. 13 where phasing check valve 62 and supply check valve 120 will be concurrently referred to as check valve 62,120. Check valve 62,120 includes a first check valve member 164 and a second check valve member 166 such that first check valve member 164 is located within first phasing volume 110*a* and second check valve member 166 is located within second phasing volume 110*b* and such that first check valve member 164 is diametrically opposed to second check valve member 166 within valve spool bore 106. First check valve member 164 and second check valve member 166 are each arcuate in shape in order to match the curvature of valve spool bore 106 and are sized to selectively block respective spool supply passages 118*a*, 118*b* or spool recirculation passages 134*a*, 134*b*. Check valve 62,120 also includes a biasing section 168 which joins first check valve member 164 and second check valve member 166. Biasing section 168 is resilient and compliant in order to bias first check valve member 164 and second check valve member 166 into contact with valve spool bore 106 while allowing first check valve member 164 and second check valve member 166 to be displaced inward under operating conditions as described previously which require flow into phasing volume 110 through spool supply passages 118*a*, 118*b* or spool recirculation passages 134*a*, 134*b*. Biasing section 168 includes a biasing section first leg 168*a* which extends axially from first check valve member 164 within first phasing volume 110*a*, a biasing section second leg 168*b* which extends axially from second check valve member 166 within second phasing volume 110*b*, and a biasing section bridge 168*c* which joins biasing section first leg 168*a* and biasing section second leg 168*b* such that biasing section bridge 168*c* is axially spaced from first check valve member 164 and from second check valve member 166. Biasing section bridge 168*c* passes between first phasing volume 110*a* and second phasing volume 110*b* through a respective insert rib positioning notch 158*b*. Biasing section bridge 168*c* and insert rib positioning notch 158*b* are sized to maintain the axial position of check valve 62,120 within phasing volume 110 to ensure that first check valve member 164 and second check valve member 166 are properly positioned to block respective spool supply passages 118*a*, 118*b* or spool recirculation passages 134*a*, 134*b* when first check valve member 164 and second check valve member 166 are biased into contact with valve spool bore 106. It should be noted that when first check valve member 164 and second check valve member 166 are opened by oil pressure, first check valve member 164 and second check valve member 166 are each received within a respective insert sidewall recess 152*c* and a respective insert rib recess 158*a*. As shown, check valve 62,120 may be a simple one-piece device that is made of formed sheet metal.

Figure 2:
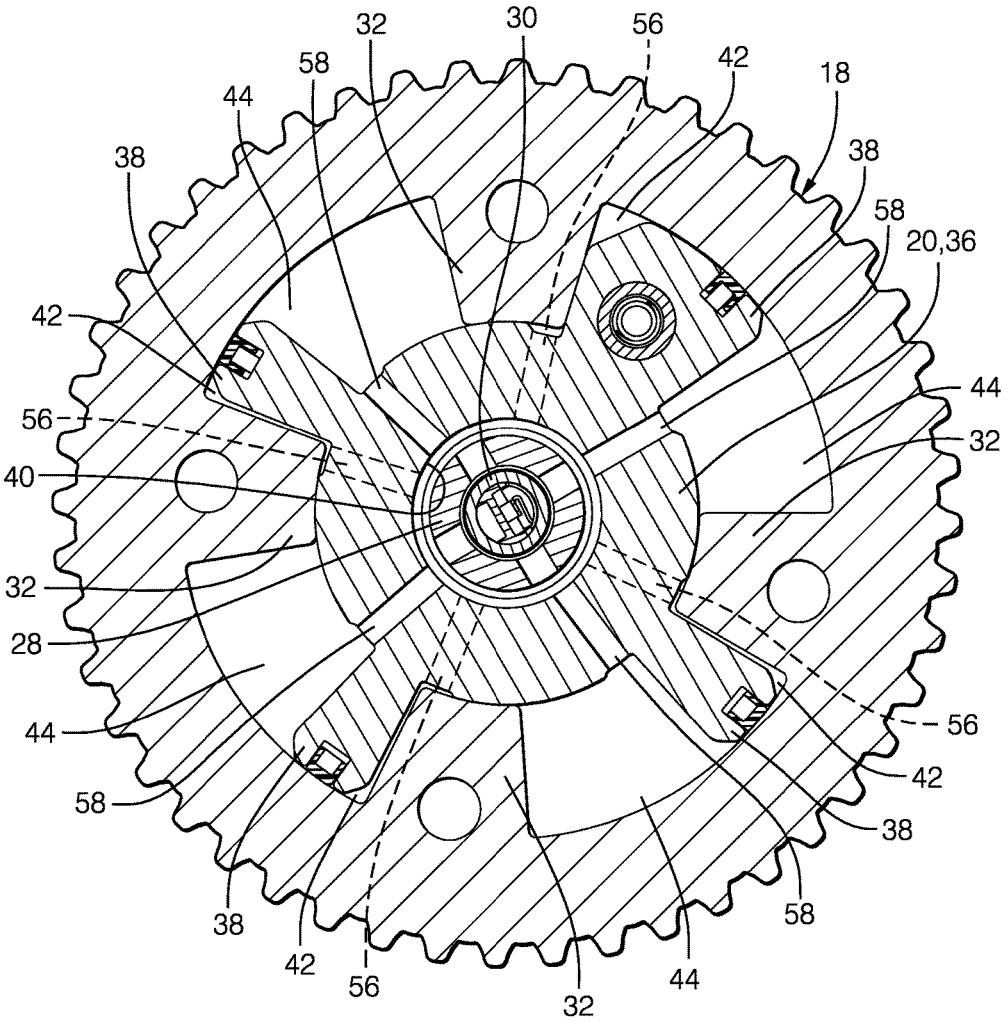
FIG. 2 is a radial cross-sectional view of the camshaft phaser in accordance with the present invention.
Figure 3:
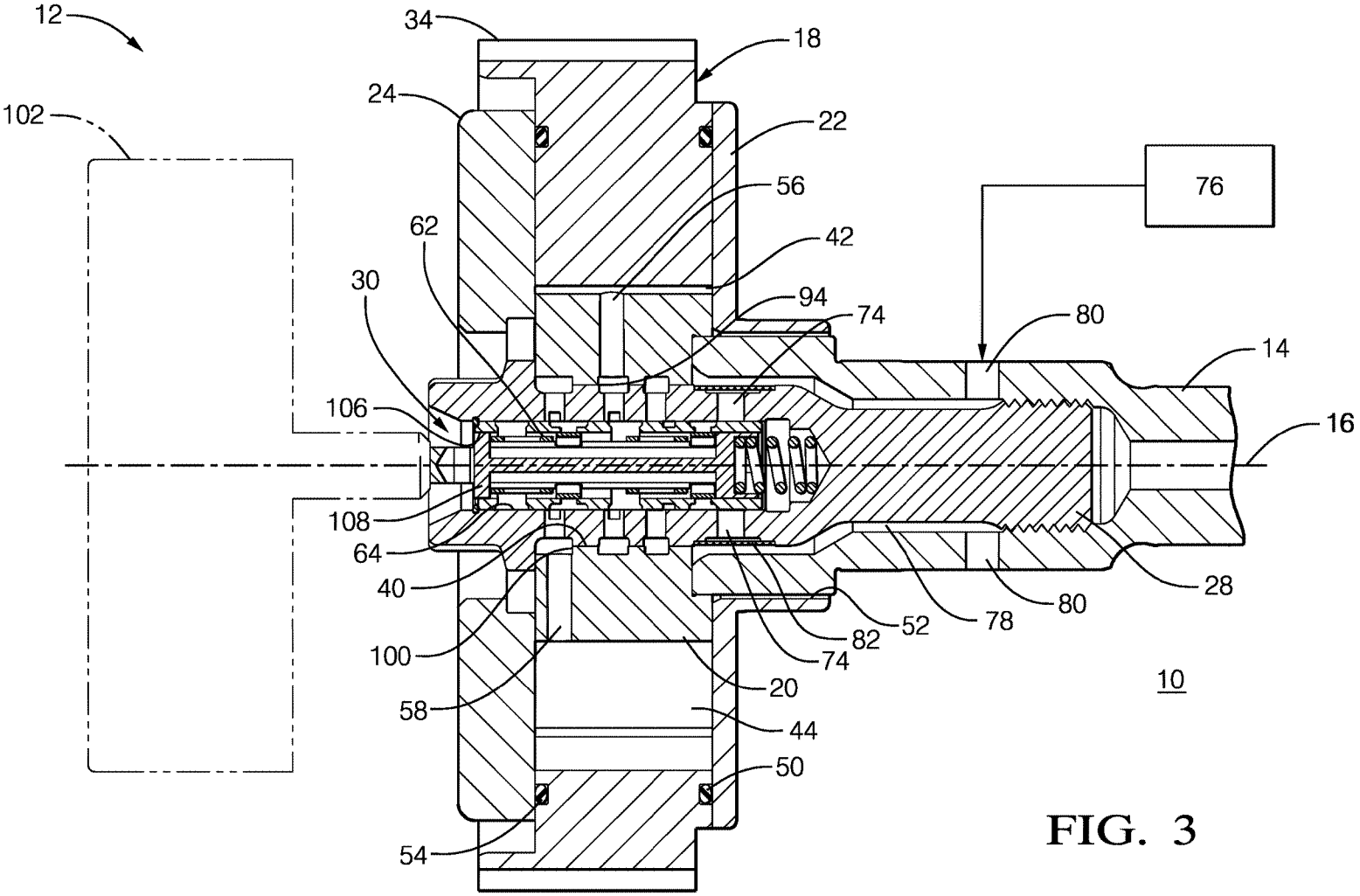
FIG. 3. is a cross-sectional view of the camshaft phaser in accordance with the present invention taken through advance and retard passages of a rotor of the camshaft phaser.
Figure 4:
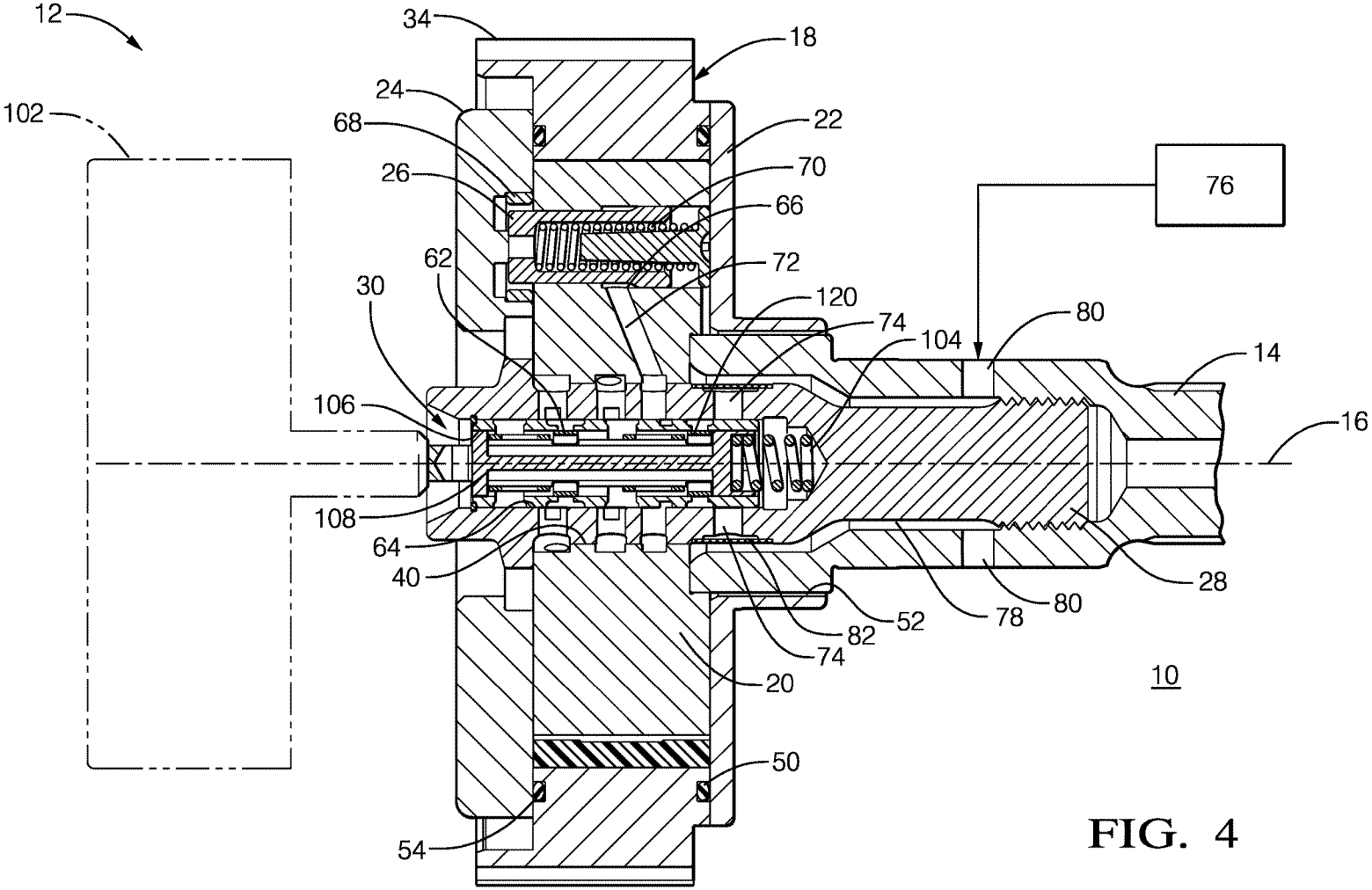
FIG. 4. is a cross-sectional view of the camshaft phaser in accordance with the present invention taken through a lock pin of the camshaft phaser.

While camshaft phaser 12 has been described as defaulting to full advance, it should now be understood that camshaft phaser 12 may alternatively default to full retard by simply rearranging oil passages. Similarly, while full advance has been described as full counterclockwise rotation of rotor 20 within stator 18 as shown in FIG. 2, it should also now be understood that full advance may alternatively be full clockwise rotation of rotor 20 within stator 18 depending on whether camshaft phaser 12 is mounted to the front of internal combustion engine 10 (shown in the figures) or to the rear of internal combustion engine 10.

While camshaft phaser attachment bolt 28 has been described herein as including grooves on the outer periphery thereof which are aligned with corresponding grooves formed in rotor central through bore 40 of rotor 20, it should now be understood that the grooves on camshaft phaser attachment bolt 28 could be omitted. Similarly, the grooves formed in rotor central through bore 40 could be omitted and the grooves on camshaft phaser attachment bolt 28 could be used to serve the same function.

Figure 15:
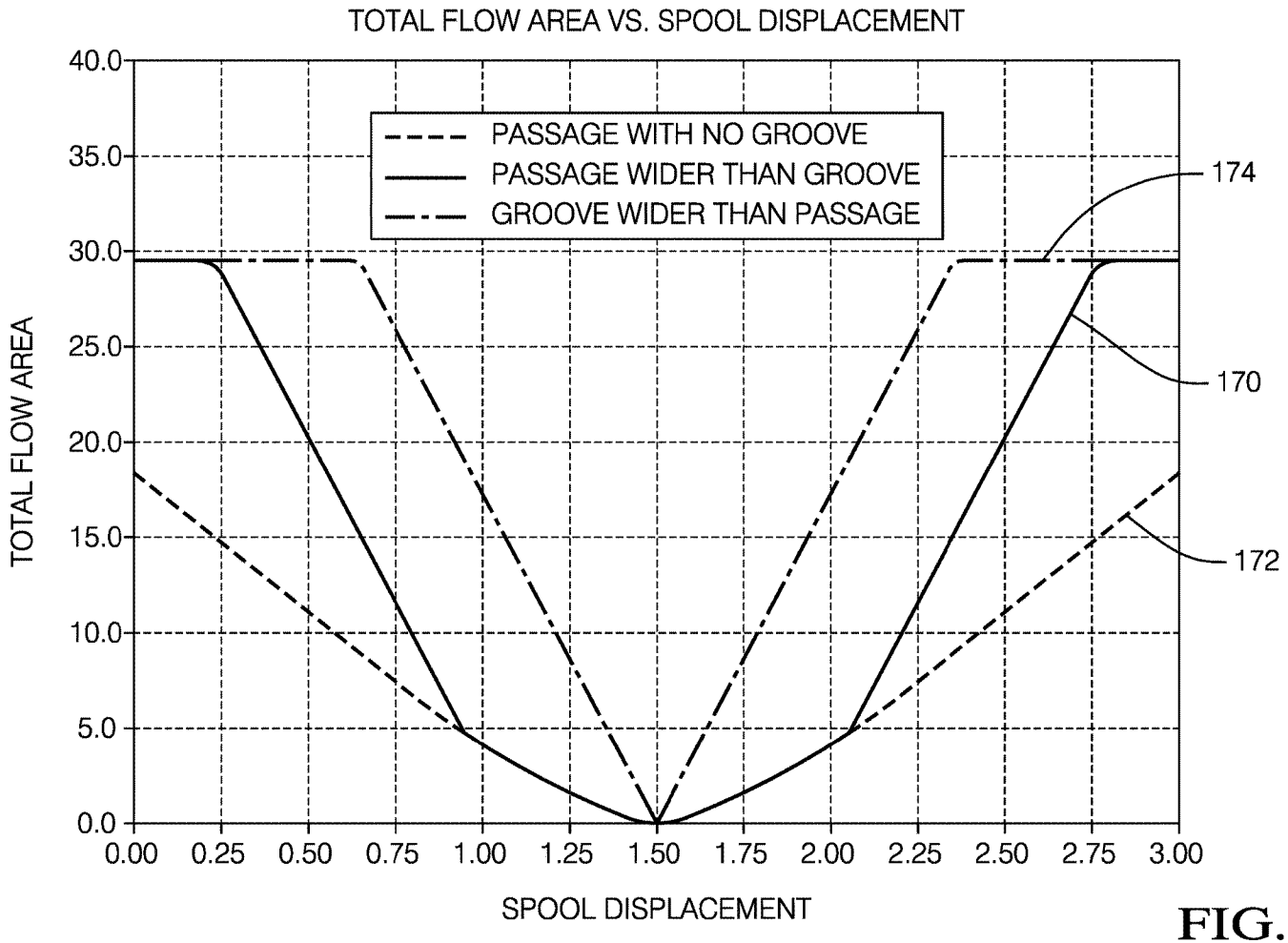
FIG. 15 is a graph comparing the total flow area provided by a valve body and valve spool in accordance with the present invention to the total flow area provided by a valve body and valve spool in two prior art configurations.

The importance of width $W_{92}$ of bolt advance passages 92 being greater than width $W_{91}$ of bolt inner annular advance groove 91 and the importance of width $W_{98}$ of bolt retard passages 98 being greater than width $W_{97}$ of bolt inner annular retard groove 97 will now be described. When valve spool 30 is in the process of moving from the hold position (FIGS. 7A and 7B) to either the advance position (FIGS. 6A and 6B) or the retard position (FIGS. 8A and 8B), valve spool 30 will first uncover the portions of bolt advance passages 92 and bolt retard passages 98 which extend axially beyond bolt inner annular advance groove 91 and bolt inner annular retard groove 97 respectively, thereby allowing an initially low flow rate of oil. However, after valve spool 30 has moved sufficiently far, valve spool 30 begins to uncover bolt inner annular advance groove 91 and bolt inner annular retard groove 97 such that the flow rate rapidly increases due to bolt inner annular advance groove 91 and bolt inner annular retard groove 97 extending around the inner perimeter of valve bore 64. In this way, valve spool 30 and camshaft phaser attachment bolt 28 yield a low gain valve assembly, i.e. initially produce a low flow rate followed by a high flow rate. FIG. 15 is a graph which shows the total flow area vs. spool displacement where trace 170 represents the total flow area provided by valve spool 30 and camshaft phaser attachment bolt 28 between either advance land 131 and bolt inner annular advance groove 91/bolt advance passages 92, i.e. the metering edges formed together by bolt inner annular advance groove 91 and bolt advance passages 92, or between retard land 138 and bolt inner annular retard groove 97/bolt retard passages 98, i.e. the metering grooves formed together by bolt inner annular retard groove 97 and bolt retard passages 98. As used herein, the total flow area is the area of the gap formed between advance land 131 and bolt inner annular advance groove 91/bolt advance passages 92 which varies based on the axial position of valve spool 30 or the area of the gap formed between retard land 138 and bolt inner annular retard groove 97/bolt retard passages 98 which varies based on the axial position of valve spool 30. Traces 172 and 174 have been provided in FIG. 15 in order to illustrate the difference in flow are provided by the present invention compared to prior art valves where trace 172 represents an arrangement where bolt inner annular advance groove 91 and bolt inner annular retard groove 97 are omitted and where trace 174 represents an arrangement where the width of bolt inner annular advance groove 91 and bolt inner annular retard groove 97 have been widened to match the width of bolt advance passages 92 and bolt retard passages 98. As can be seen in FIG. 15, the center portion of trace 172 matches the center portion of trace 170, i.e. from a displacement of about 0.95 to a displacement of about 2.05. However, due to the absence of bolt inner annular advance groove 91 and bolt inner annular retard groove 97, the flow area is limited to the portion of the bolt flow passages that are uncovered, thereby resulting in reduced flow which ultimately reduces the phasing rate of the camshaft phaser. With respect to trace 174, there is an abrupt increase in total flow area because the valve lands immediately begin to uncover bolt inner annular advance groove 91 and bolt inner annular retard groove 97 due to bolt advance passages 92 and bolt retard passages 98 no longer extending axially beyond bolt inner annular advance groove 91 and bolt inner annular retard groove 97. Since there is an abrupt increase in total flow area, a small error in the position of valve spool 30 can have a drastic, unintended effect on the position of rotor 20 relative to stator 18. In this way, control stability of camshaft phaser 12 may be sacrificed in an arrangement where the passages are narrower than the groove. However, flow is ultimately limited by the flow area of bolt advance passages 92 and bolt retard passages 98, and consequently, the effective maximum flow rate into and out of valve bore 64 is the same for both traces 170 and 174.

While the present invention has been embodied in a camshaft phaser which uses a valve arrangement within the camshaft phaser to move oil resulting from torque reversals of the camshaft, it should now be understood that the present invention is also applicable to camshaft phasers which use pressurized oil, for example from a pump rather than oil that has been pressurized by torque reversals of the camshaft. It should also be understood that the present invention is also applicable to camshaft phasers in which the valve body and valve spool are not located within the camshaft phaser. Furthermore, the present invention is also applicable to valves which are not used in connection with camshaft phasers and is therefore useful in many applications which require a valve to control flow of fluid.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve body having a valve bore which extends along an axis, an annular groove which extends radially outward from said valve bore and surrounds said axis such that said annular groove has a first width in the direction of said axis, and a passage which opens into said annular groove and which extends from said valve bore through said valve body in a direction that is radially outward from said valve bore such that said passage is in fluid communication with one of said advance chamber and said retard chamber and such that said passage has a second width in the direction of said axis that is greater than said first width of said annular groove;

a valve spool which moves along said axis within said valve bore between an advance position and a retard position, said valve spool having a land which varies a flow area between said valve bore and said annular groove and between said valve bore and said passage, thereby controlling flow of oil into and out of said one of said advance chamber and said retard chamber which causes said input member to move relative to said output member.

2. A camshaft phaser as in claim 1 wherein said passage extends beyond said annular groove in each direction of said axis.

3. A camshaft phaser as in claim 2 wherein said passage extends beyond said annular groove by at least 10% of said first width in each direction of said axis.

4. A camshaft phaser as in claim 2 wherein said passage extends beyond said annular groove by between 10% and 25% of said first width in each direction of said axis.

5. A camshaft phaser as in claim 1 wherein said annular groove and said passage together define a metering edge.

6. A camshaft phaser as in claim 1 wherein:

said annular groove is an annular advance groove having said first width;

said passage is one of a plurality of advance passages which open into said annular advance groove and which extends from said valve bore through said valve body in a direction that is radially outward from said valve bore such that each of said plurality of advance passages is in fluid communication with said advance chamber and such that each of said plurality of advance passages has said second width in the direction of said axis that is greater than said first width of said annular advance groove;

said land is an advance land which varies a flow area between said valve bore and said annular advance groove and between said valve bore and said plurality of advance passages, thereby controlling flow of oil into and out of said advance chamber;

said valve body also has an annular retard groove which extends radially outward from said valve bore and surrounds said axis such that said annular retard groove has a third width in the direction of said axis, and a plurality of retard passages which each open into said annular retard groove and which extend from said valve bore through said valve body in a direction that is radially outward from said valve bore such that each of said plurality of retard passages is in fluid communication with said retard chamber and such that each of said plurality of retard passages has a fourth width in the direction of said axis that is greater than said third width of said annular retard groove, said annular retard groove being spaced axially from said annular advance groove; and said valve spool also has a retard land which varies a flow area between said valve bore and said annular retard groove and between said valve bore and said plurality of retard passages, thereby controlling flow of oil into and out of said retard chamber.

7. A camshaft phaser as in claim 6 wherein:

each of said plurality of advance passages extend beyond said annular advance groove in each direction of said axis; and each of said plurality of retard passages extend beyond said annular retard groove in each direction of said axis.

8. A camshaft phaser as in claim 6 wherein:

said annular advance groove and each of said plurality of advance passages together define an advance metering edge; and said annular retard groove and each of said plurality of retard passages together define a retard metering edge.

9. A valve assembly comprising:

a valve body having a valve bore which extends along an axis, an annular groove which extends radially outward from said valve bore and surrounds said axis such that said annular groove has a first width in the direction of said axis, and a passage which opens into said annular groove and which extends from said valve bore through said valve body in a direction that is radially outward from said valve bore such that said passage has a second width in the direction of said axis that is greater than said first width of said annular groove;

a valve spool which moves along said axis between a first position and a second position, said valve spool having a land which varies a flow area between said valve bore and said annular groove and between said valve bore and said passage as said valve spool moves between said first position and said second position, thereby controlling flow of fluid through said passage.

10. A valve assembly as in claim 9 wherein said passage extends beyond said annular groove in each direction of said axis.

11. A valve assembly as in claim 10 wherein said passage extends beyond said annular groove by at least 10% of said first width in each direction of said axis.

12. A camshaft phaser as in claim 10 wherein said passage extends beyond said annular groove by between 10% and 25% of said first width in each direction of said axis.

13. A valve assembly as in claim 9 wherein said annular groove and said passage together define a metering edge.

* * * * *